US008511428B2

(12) United States Patent
Tange et al.

(10) Patent No.: US 8,511,428 B2
(45) Date of Patent: Aug. 20, 2013

(54) NOISE ATTENUATOR AND VEHICLE AIR INTAKE DUCT PROVIDED THEREWITH

(75) Inventors: Katsuhiro Tange, Anjo (JP); Takashi Yamaguchi, Anjo (JP)

(73) Assignee: Inoac Corporation, Nagoya (JP)

( * ) Notice: Subject to any disclaimer, the term of this patent is extended or adjusted under 35 U.S.C. 154(b) by 36 days.

(21) Appl. No.: 13/154,041

(22) Filed: Jun. 6, 2011

(65) Prior Publication Data

US 2012/0024623 A1 Feb. 2, 2012

(30) Foreign Application Priority Data

Jul. 28, 2010 (JP) ..... 2010-169064
Oct. 25, 2010 (JP) ..... 2010-238818
Nov. 16, 2010 (JP) ..... 2010-255779

(51) Int. Cl.

| | |
|---|---|
| ***F02M 35/00*** | (2006.01) |
| ***F01N 1/00*** | (2006.01) |
| ***F01N 13/02*** | (2010.01) |
| ***F01N 13/08*** | (2010.01) |
| ***E04F 17/04*** | (2006.01) |

(52) U.S. Cl.
USPC ..... 181/229; 181/224; 181/227; 181/232; 181/254

(58) Field of Classification Search
USPC ..... 181/229, 227, 232, 224
See application file for complete search history.

(56) References Cited

U.S. PATENT DOCUMENTS

| | | | | |
|---|---|---|---|---|
| 5,493,080 | A * | 2/1996 | Moss | 181/232 |
| 6,327,368 | B1 | 12/2001 | Yamaguchi et al. | |
| 7,628,250 | B2 * | 12/2009 | Abram et al. | 181/254 |
| 2008/0017440 | A1 * | 1/2008 | Seko et al. | 181/175 |

FOREIGN PATENT DOCUMENTS

| | | | |
|---|---|---|---|
| DE | 103 22 570 | A1 | 1/2005 |
| DE | 10322570 | A1 * | 1/2005 |
| JP | A-5-46189 | | 2/1993 |
| JP | A-10-281027 | | 10/1998 |
| JP | A-11-029999 | | 2/1999 |
| JP | A-2005-292620 | | 10/2005 |
| JP | A-2008-25472 | | 2/2008 |

OTHER PUBLICATIONS

Jan. 19, 2012 Extended European Search Report issued in Patent Application No. 11174215.1.

* cited by examiner

*Primary Examiner* — David Warren
*Assistant Examiner* — Christina Russell
(74) *Attorney, Agent, or Firm* — Oliff & Berridge, PLC

(57) ABSTRACT

A noise attenuator which can reduce time and cost for installation thereof as compared with the conventional configuration and a vehicle air intake duct provided with the noise attenuator are provided. The noise attenuator includes a pair of circular through holes formed through a duct wall, a pair of wave transmitting/receiving membrane which are stretched so as to close the circular through holes, and a seesaw member which connects between central portions of the paired transmitting/receiving membranes. Accordingly, when one of the membranes receives a sound wave of noise thereby to be vibrated at a predetermined frequency, the other membrane follows it and is also vibrated while shifted by a half cycle. As a result, a cancellation wave with a phase opposite to the sound wave received by the one membrane is transmitted from the other membrane, whereupon the noise can be attenuated.

17 Claims, 23 Drawing Sheets

NOISE ATTENUATOR AND VEHICLE AIR INTAKE DUCT PROVIDED THEREWITH

CROSS-REFERENCE TO RELATED APPLICATIONS

This application is based upon and claims the benefit of priority from the prior Japanese Patent Applications No. 2010-169064 filed on Jul. 28, 2010, No. 2010-238818 filed on Oct. 25, 2010, and No. 2010-255779 filed on Nov. 16, 2010 the entire contents of which are incorporated herein by reference.

BACKGROUND

1. Technical Field

The present invention relates to a noise attenuator which attenuates noise by producing a cancellation wave having a phase substantially opposite to a sound wave of the noise, and a vehicle air intake duct provided with the noise attenuator.

2. Description of the Related Art

A noise attenuator of the above-described type has conventionally been known in which noise is detected by a microphone and a cancellation wave having a phase substantially opposite to a sound wave of the detected noise is generated by an electric circuit and then output from a loud speaker (see Japanese Patent Application Publication No. JP-A-H05-46189, for example).

However, the aforementioned noise attenuator necessitates a dustproof or waterproof treatment and wiring processing in order to protect the electric circuit for generating the cancellation wave, resulting in a problem that installation thereof requires substantial time and cost.

SUMMARY OF THE INVENTION

Therefore, an object of the present invention is to provide a noise attenuator which can reduce time and cost for installation thereof as compared with the conventional configuration and a vehicle air intake duct provided with the noise attenuator.

The present invention provides a noise attenuator for reducing noise transmitting in a duct, comprising a pair of circular through holes formed through a duct wall; a pair of wave transmitting/receiving membranes which are stretched so as to close the respective circular through holes, receive a sound wave, and vibrate; and a seesaw member which connects between central portions of the paired wave transmitting/receiving membranes and is pivotally supported with respect to the duct so as to be capable of transmitting vibration between the paired wave transmitting/receiving membranes.

The present invention also provides a vehicle air intake duct which is disposed along an air intake passage of an engine and provided with the noise attenuator described above.

According to the above-described noise attenuator and the vehicle air intake duct, a noise attenuation effect according to the experimental results described below can be achieved. A noise attenuating mechanism will be estimated as follows. The noise attenuator of the present invention comprises the paired wave transmitting/receiving membranes which receive sound waves thereby to vibrate. Since a sound wave has a pressure changing in a predetermined period, the membranes are vibrated in such a manner as to repeat alternately a state of swelling inward and a state of swelling outward depending on frequencies of the noise when receiving the sound wave of the noise. Furthermore, the seesaw member or vibration transmitting member is provided to connect between the paired membranes. Accordingly, when one of the membranes receives a sound wave of noise thereby to be vibrated at a predetermined frequency, the other membrane follows it and is also vibrated at the same frequency, and a swelling direction of the one membrane is normally opposed to a swelling direction of the other membrane. As a result, a cancellation wave with a phase opposite to the sound wave received by the one membrane is transmitted from the other membrane, whereupon the noise can be attenuated. Moreover, since no electrical circuit for generating the cancellation wave is provided, the conventional dustproof or waterproof treatment and wiring processing are rendered unnecessary. This can realize low-cost installation of the noise attenuator.

Furthermore, when the paired membranes are arranged along a direction of sound transmission in the noise attenuator and the duct of the present invention, a pressure difference due to the receiving of sound waves between the paired membranes tends to be easily caused and the membranes can be rendered easier to vibrate if the noise has a low frequency wave. This can improve the noise attenuation effects. Additionally, the experiment that will be described later confirms that a higher noise attenuation effect can be achieved in the case where the paired membranes are arranged in the direction of sound transmission when the noise contains low frequency waves, although a certain noise attenuation effect is achieved when the membranes are arranged in a direction perpendicular to the direction of sound transmission.

Furthermore, a foreign-matter removing hole is provided to an interference avoiding recess depressedly formed on the duct wall in order to avoid interference with a central leg of the seesaw member. In this case, even if foreign matter such as dust should enter the interference avoiding recess, the foreign matter would be discharged through the interference avoiding recess into the duct, thereupon being prevented from remaining in the interference avoiding recess. This can maintain the seesaw member in a smoothly pivotable state.

The noise attenuator and the duct of the present invention further comprises pivot shafts which protrude from both side surfaces of the central leg of the seesaw member in directions opposed to each other respectively and a pair of shaft support grooves which are formed at both sides of the interference avoiding recess respectively. In this case, the pivot shafts can be assembled to the shaft support grooves from a direction perpendicular to axial directions thereof, whereupon assembling work of the seesaw member to the duct is facilitated.

Additionally, the noise attenuator and the duct of the present invention further comprises an inner limiting member which is opposed to the inner surfaces of the wave transmitting/receiving membranes with a gap being defined therebetween. The inner limiting member is formed into a grid shape, a reticular shape, a bar shape or a beam shape. In this case, when a large negative pressure is applied inside the air intake duct, the membrane having been deformed inward by the negative pressure abuts against the inner limiting member thereby to be prevented from excessive deformation. Furthermore, the inner limiting member limits abutment of foreign matter onto the membranes. This can prevent reduction in the noise attenuating performance of the membrane type noise attenuation mechanism and improve the durability.

DETAILED DESCRIPTION

Figure 1:
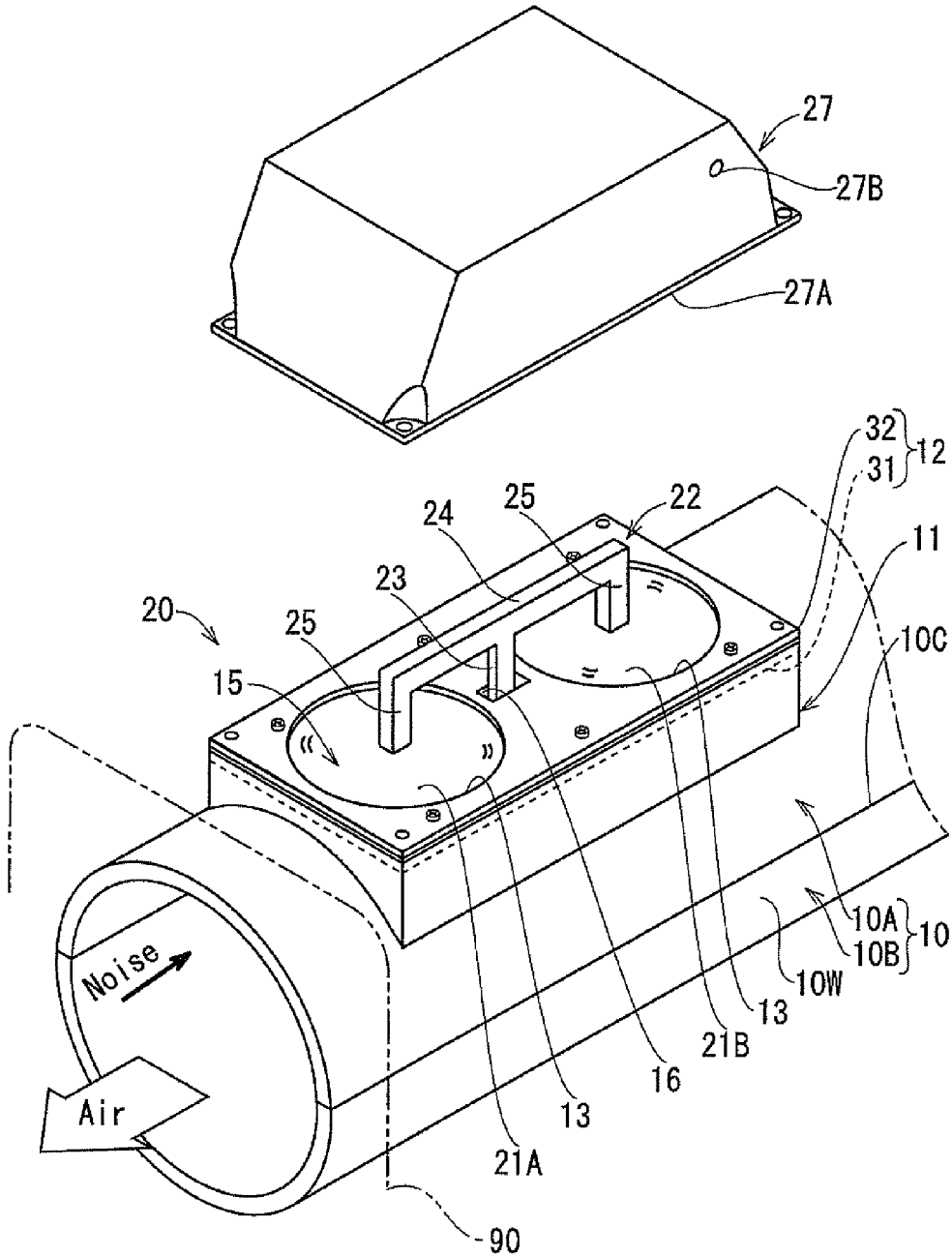
FIG. 1 is a perspective view of an air intake duct provided with the noise attenuator of a first embodiment.

An embodiment will now be described with reference to FIGS. 1 to 5B. Referring to FIG. 1, a part of a vehicle air intake duct (hereinafter, a "duct") 10 provided with a noise attenuator 20 of the present invention is shown. The duct 10 has one of two ends which is connected to an internal combustion engine 90 side of a vehicle and the other end from which air is taken in and guided to the engine 90. Since the duct 10 is a conduit path transmitting noise from the engine 90, the noise attenuator 20 is provided for attenuating noise.

More specifically, the duct 10 is formed into a horizontally extending cylindrical shape and divided into upper and lower duct constructs 10A and 10B at a division surface 10C inclusive of a central axis, for example. The duct constructs 10A and 103 are made of a resin by injection molding and are fixed together by vibration welding.

The duct 10 includes a duct wall 10W defining an interior and an exterior thereof. The duct wall 10W has a part which is upwardly swollen thereby to serve as a box-shaped swollen part 11. The swollen part 11 is formed into a rectangular parallelepiped extending in the axial direction of the duct 10 and has a distal end provided with a rectangular flat plate-shaped base wall 12 having a pair of circular through holes 13 arranged axially with respect to the duct 10. Membrane members 15 are stretched so as to close the paired circular through holes 13 thereby to be formed into a pair of wave transmitting/receiving membranes 21A and 21B respectively. A seesaw member 22 is provided so as to connect between centers of the membranes 21A and 218. The noise attenuator 20 is thus constructed.

Figure 2:
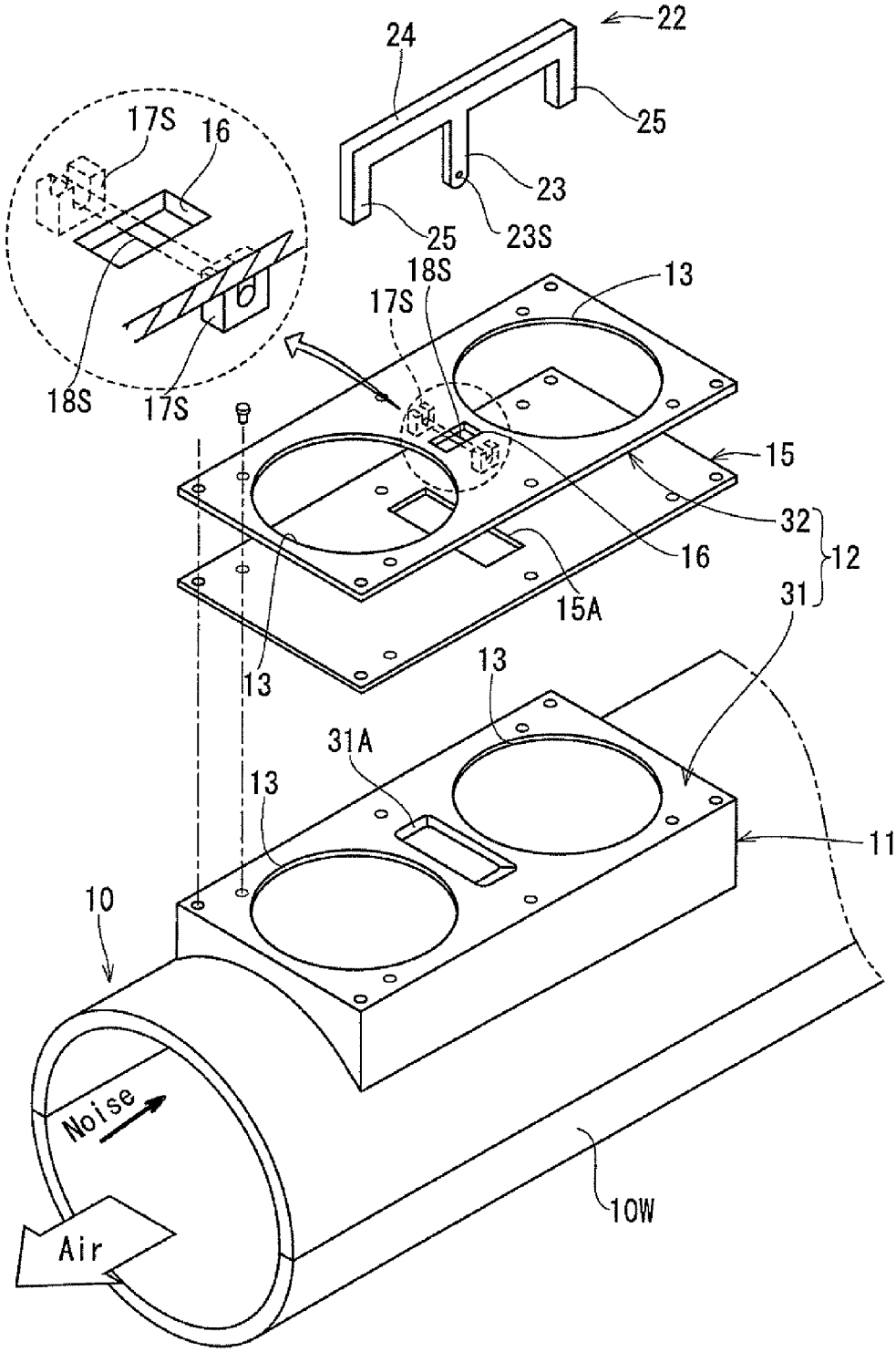
FIG. 2 is an exploded perspective view of the duct.

In more detail, as shown in FIG. 2, the base wall 12 comprises a first base plate member 31 formed integrally on a sidewall upper end of the box-shaped swollen part 11 into the shape of a rectangular flat plate and a second base plate member 32 placed on an outer surface of the first base plate member 31, for example. The through holes 13 have the same diameter and are formed in the first and second base plate members 31 and 32 at the same pitch respectively. An adhesive is applied to opposed surfaces of the first and second base plate members 31 and 32 respectively. The membrane members 15 are placed between the opposed surfaces of the first and second base plate members 31 and 32 and fastened up by a plurality of small screws together with the first and second base plate members 31 and 32. Parts of the membrane members 15 exposed from the through holes 13 serve as the membranes 21A and 2113 (see FIG. 1).

Each membrane member 15 is a rubber or resin sheet and is more particularly made of ethylene propylene diene rubber (EPDM), thermoplastic polyurethane (TPU), thermoplastic polyolefin (TPO), polyvinyl chloride (PVC) or polyethylene telephthalate (PET). Each membrane member 15 has a thickness ranging from 0.1 to 1.0 mm, for example.

The second base plate member 32 has a slit 16 formed between the through holes 13. The slit 16 extends along an imaginary line connecting between the centers of the through holes 13. The second base plate member 32 further has a pair of shaft support protrusions 17S formed at the surface opposed to the first base plate member 31 so as to protrude from both widthwise sides of the slit 16. A pivot shaft 18S is arranged between the shaft support protrusions 175.

Figure 3:
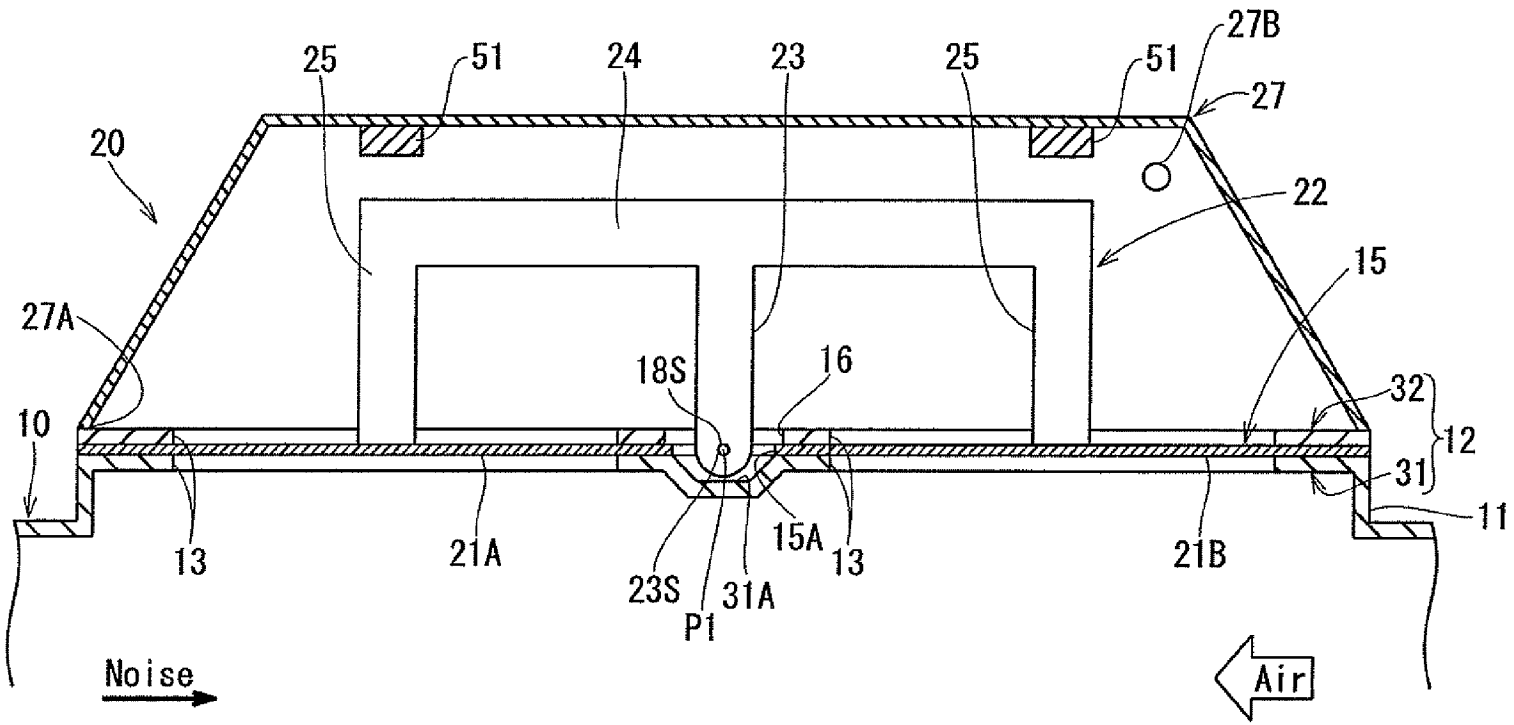
FIG. 3 is a side sectional view of the duct.

The pivot shaft 18S is disposed at the middle between the centers of the through holes 13 so as to be coplanar with the membrane members 15 (see FIG. 3). The seesaw member 22 has a central leg 23 which is inserted through the slit 16 from the outer surface side of the second base member 32 as will be described later. The central leg 23 has an end formed with a shaft insertion hole 23S through which the pivot shaft 18S is inserted, whereby the seesaw member 22 is pivotally supported on the base wall 12 via the pivot shaft 18S. The membrane member 15 is formed with an interference avoiding hole 15A in order that interference may be avoided between the lower end of the central leg 23 and the membrane member 15 and the first base plate member 31. The first base plate member 31 has an interference avoiding recess 31A depressedly formed in an outer surface thereof.

The seesaw member 22 is a generally E-shaped resin plate and includes a connecting portion 24 extending along the imaginary line connecting between the centers of the through holes 13, the central leg 23 extending from a lengthwise center of the connecting portion 24 in a direction perpendicular to the connecting portion 24 and a pair of end legs 25 extending from both ends of the connecting portion 24 in parallel with the central leg 23, as shown in FIG. 1. Furthermore, as shown in FIG. 3, distal end surfaces of the end legs 25 and the shaft insertion hole 235 of the central leg 23 are coplanar with each other. A distance between centers of the distal end surfaces of the end legs 25 is equal to a distance between the centers of the membranes 21A and 21B. The distal end of the central leg 23 is pivotally supported on the base wall 12 via the pivot shaft 18S as described above. The distal ends of the end legs 25 are fixed to the outer surfaces of the membranes 21A and 21B by the adhesive while the centers of the distal ends of the end legs 25 correspond with the centers of the membranes 21A and 21B respectively. In the embodiment, a curved portion comprises one of the end legs 25 of the seesaw member 22, the central leg 23 and the connecting portion 24 between the end leg 25 and the central leg 23 and serves as a first curved portion of the present invention. Another curved portion comprises the other end leg 25, the central leg 23 and the connecting portion 24 between the other end leg 25 and the central leg 23 and serves as a second curved portion of the present invention.

An outer surface of the noise attenuator 20 is covered with an outer surface cover 27. The outer surface cover 27 has a trapezoidal box shaped structure with an open bottom. The outer surface cover 27 is fixed to the base wall 12 by small screws while an opening edge of a rectangular opening 27A of the bottom is applied to the outer edge of the second base plate member 32.

A pair of pivot limiting stoppers 51 are provided so as to be opposed to both ends of the seesaw member 22 at two locations where an inner surface of the outer surface cover 27 intersects with center lines of the wave transmitting/receiving membranes 21A and 21B, as shown in FIG. 3. The pivot limiting stoppers 51 remain spaced from the seesaw member 22 in a normal use of the noise attenuator 20. However, the pivot limiting stoppers 51 abut against the seesaw member 22 to prevent excessive deformation of the membrane 21A under an abnormal condition where the membrane 21A is pressed by a tool or the like such that the seesaw member 22 is caused to pivot.

Figure 4A:
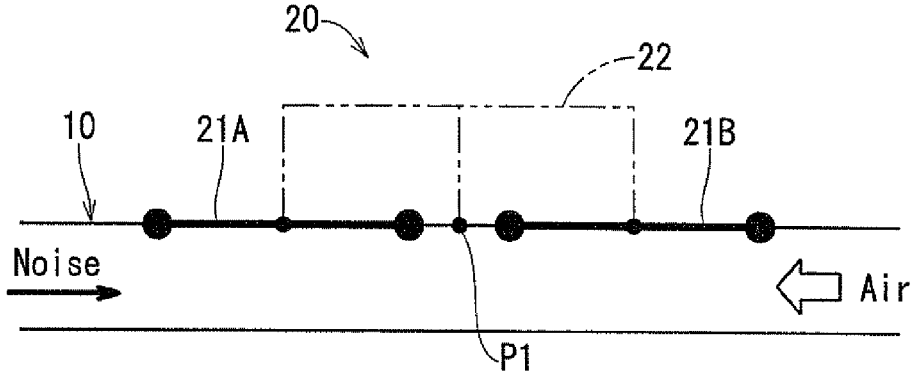
FIGS. 4A to 4C are schematic views showing the operation of the noise attenuator respectively.

The noise attenuator 20 of the embodiment is constructed as described above. Next, the operation and effects of the noise attenuator 20 will be described. The engine 90 is operated by executing air intake through the duct 10. As a result, sound produced by the air intake of the engine 90 results in noise. The noise propagates in a direction opposed to the direction of air intake in the duct 10 thereby to be discharged out of the duct 10, as shown in FIG. 4A. However, since the duct 10 is provided with the noise attenuator 20 of the present invention, the noise is attenuated as confirmed by the experiment which will be described later. The mechanism of attenuating noise will be estimated as follows.

Figure 4B:
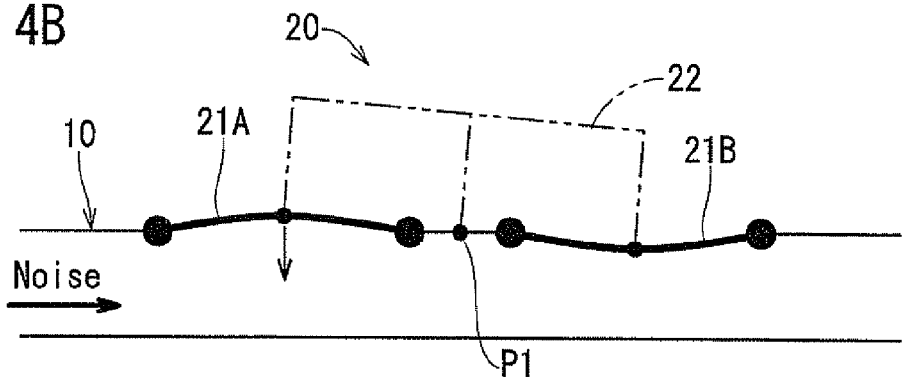
Figure 4C:
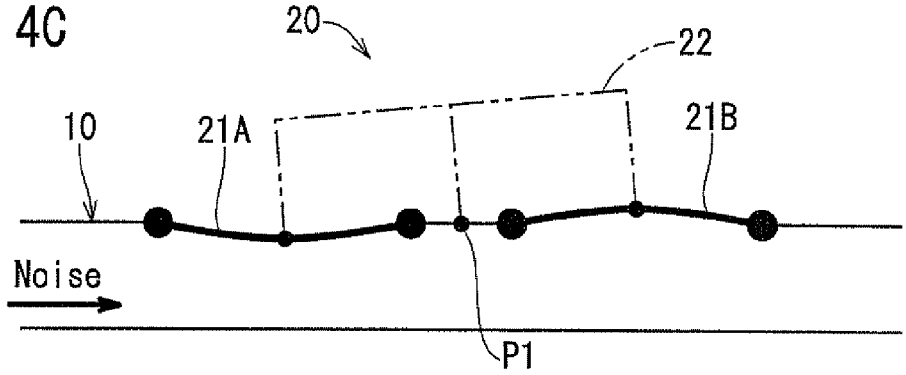

Since a sound wave has pressure changing in a predetermined period, the membrane 21A is vibrated in such a manner as to alternately repeat an inwardly swelling state and an outwardly swelling state according to the noise frequency upon receipt of sound waves. Herein, the membranes 21A and 21B are connected by the seesaw member 22. Accordingly, when the membrane 21A receives a sound wave of noise thereby to be vibrated in a predetermined period, the other membrane 21B follows it and is also vibrated in the same period, and the swelling directions of the membranes 21A and 21B are normally opposed to each other as shown in FIGS. 4B and 4C. As a result, a cancellation wave having an opposite phase to the sound wave received by the membrane 21A is transmitted from the other membrane 21B, whereupon the noise can be attenuated. Moreover, since the noise attenuator 20 of the embodiment requires no electric circuit for generating cancellation waves, the conventional dustproof or waterproof treatment and wiring arrangement are rendered unnecessary. This can realize low-cost installation of the noise attenuator on vehicles.

Figure 5A:
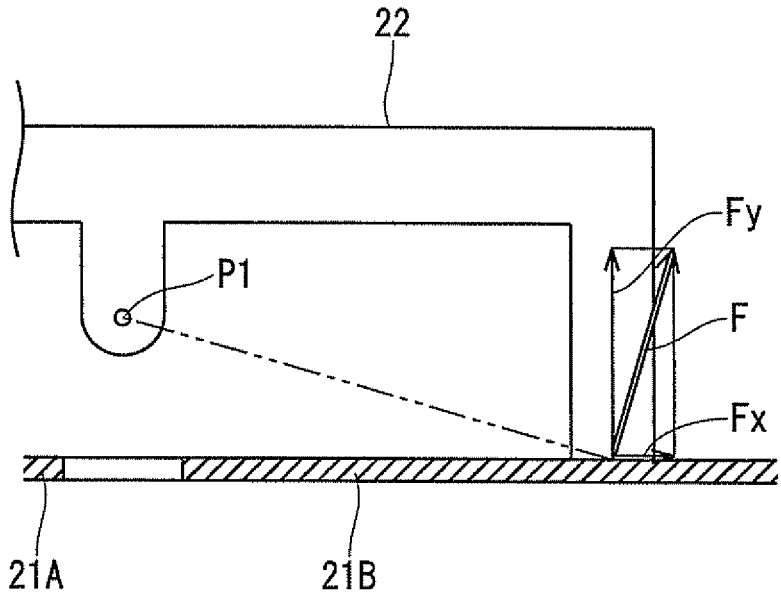
FIGS. 5A and 5B are side sectional views, showing a part of a modified form of the noise attenuator.
Figure 5B:
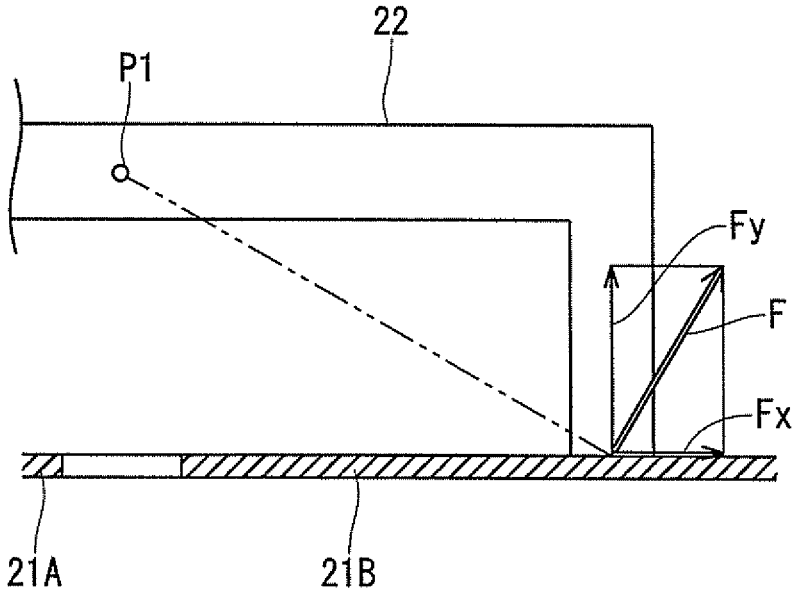

Furthermore, the paired membranes 21A and 21B and the pivot center P1 of the seesaw member 22 are disposed so as to be coplanar with each other as shown in FIG. 3. Accordingly, a force component in the direction parallel to the membranes 21A and 21B is suppressed in force acting between the membranes 21A and 21B and the seesaw member 22, whereas a force component in the direction perpendicular to the membranes 21A and 21B is increased. More specifically, when the pivot center P1 of the seesaw member 22 is set apart from the plane inclusive of the paired membranes 21A and 21B as shown in FIGS. 5A and 5B by comparison, a force component Fx in the direction parallel to the membrane 21B is rendered larger in a force F the seesaw member 22 applies to the membrane 21B, as the distance between the pivot center P1 and the membranes 21A and 21B becomes longer (note that force Fx in FIG. 5B is larger than the force Fx in FIG. 5A). On the other hand, a force component Fy in the direction perpendicular to the membrane 21B is reduced. In the case of the noise attenuator 20 of the embodiment, however, the paired membranes 21A and 21B and the pivot center P1 of the seesaw member 22 are disposed so as to be coplanar with each other. Accordingly, the force component Fx in the direction parallel to the membrane 21B is rendered the smallest (suppressed to zero) in the force F the seesaw member 22 applies to the membrane 21B, whereas the force component Fy in the direction perpendicular to the membrane 21B is rendered the largest. The same is applicable to the force the seesaw member 22 receives from the membrane 21A although this is not shown in the drawings. As a result, the vibration of the membranes 21A and 21B is rendered stable and the vibration received by one of the membranes 21A and 21B can efficiently be transmitted to the other.

Furthermore, the paired membranes 21A and 21B are constituted by placing the common membrane member 15 between the paired first and second base plate members 31 and 32 having the paired circular through holes 13 respectively. Consequently, the number of components can be reduced in the embodiment as compared with the case where the membranes 21A and 21B are constituted by individual membrane members. Additionally, since the seesaw member 22 is covered by the cover 27 in the embodiment, the seesaw member 22 can be prevented from abutting against the other components, whereupon the duct 10 can be treated easily.

Second Embodiment

The following describes the difference of the configuration of a noise attenuator 20V of a second embodiment from the noise attenuator 20 of the first embodiment with reference to FIGS. 6 to 14.

Figure 7:
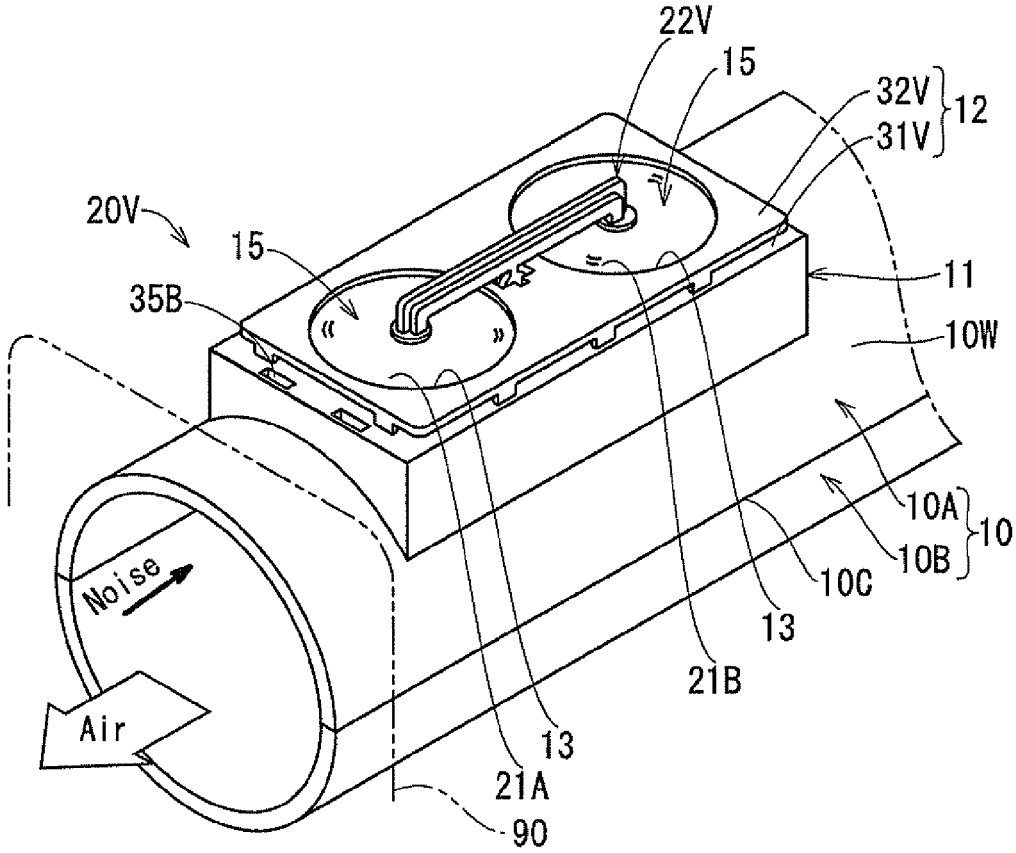
FIG. 7 is a perspective view of the duct with an outer surface cover being removed.
Figure 9:
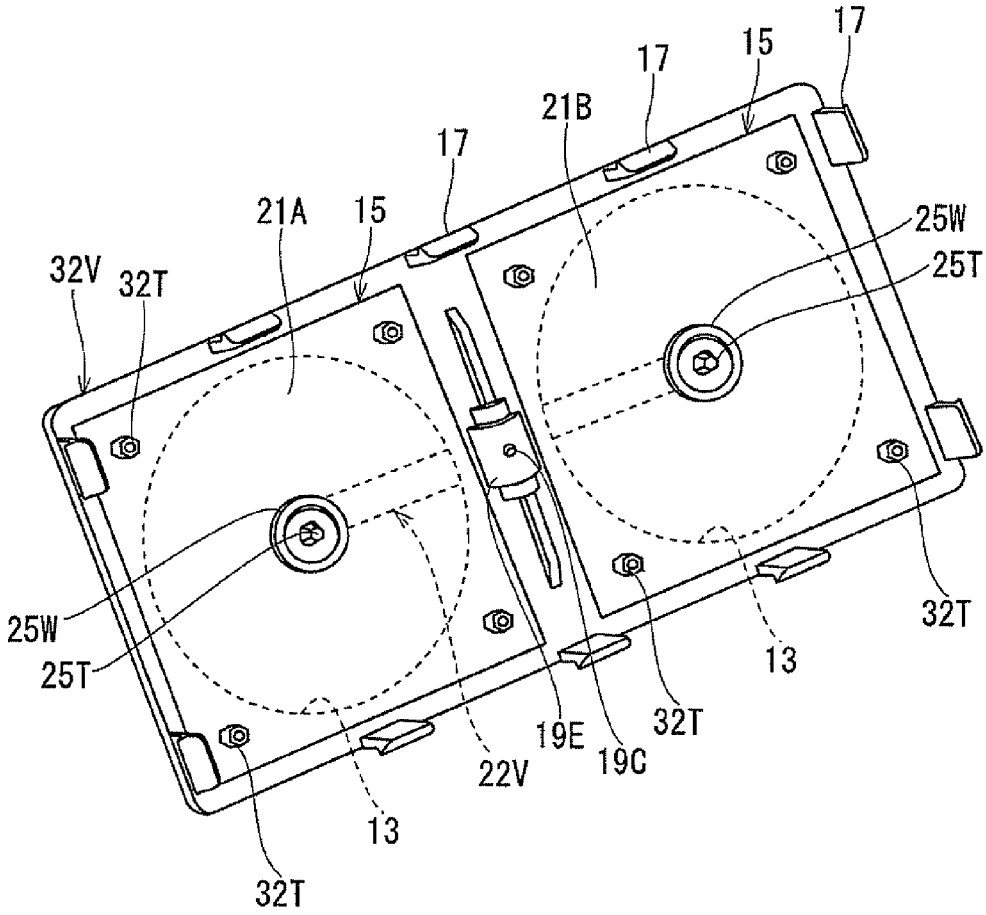
FIG. 9 is a perspective view of the underside of a second base plate.

The noise attenuator 20V of the second embodiment includes a second base plate member 32V which is formed into a rectangular shape slightly smaller than the first base plate member 31V, as shown in FIG. 7. Furthermore, a pair of square membrane members 15 are placed on the underside of the second base plate member 32V so as to close the circular through holes 13 respectively as shown in FIG. 9. A plurality of membrane fixing protrusions 32T protruding from the underside of the second base plate member 32V penetrate four corners of respective membrane members 15. Each membrane member 15 and the underside of the second base plate member 32V are fixed together by an adhesive, for example. Each membrane member 15 includes a part exposed from the circular through hole 13 and serving as the wave transmitting/receiving membrane 21A or 218.

Figure 8:
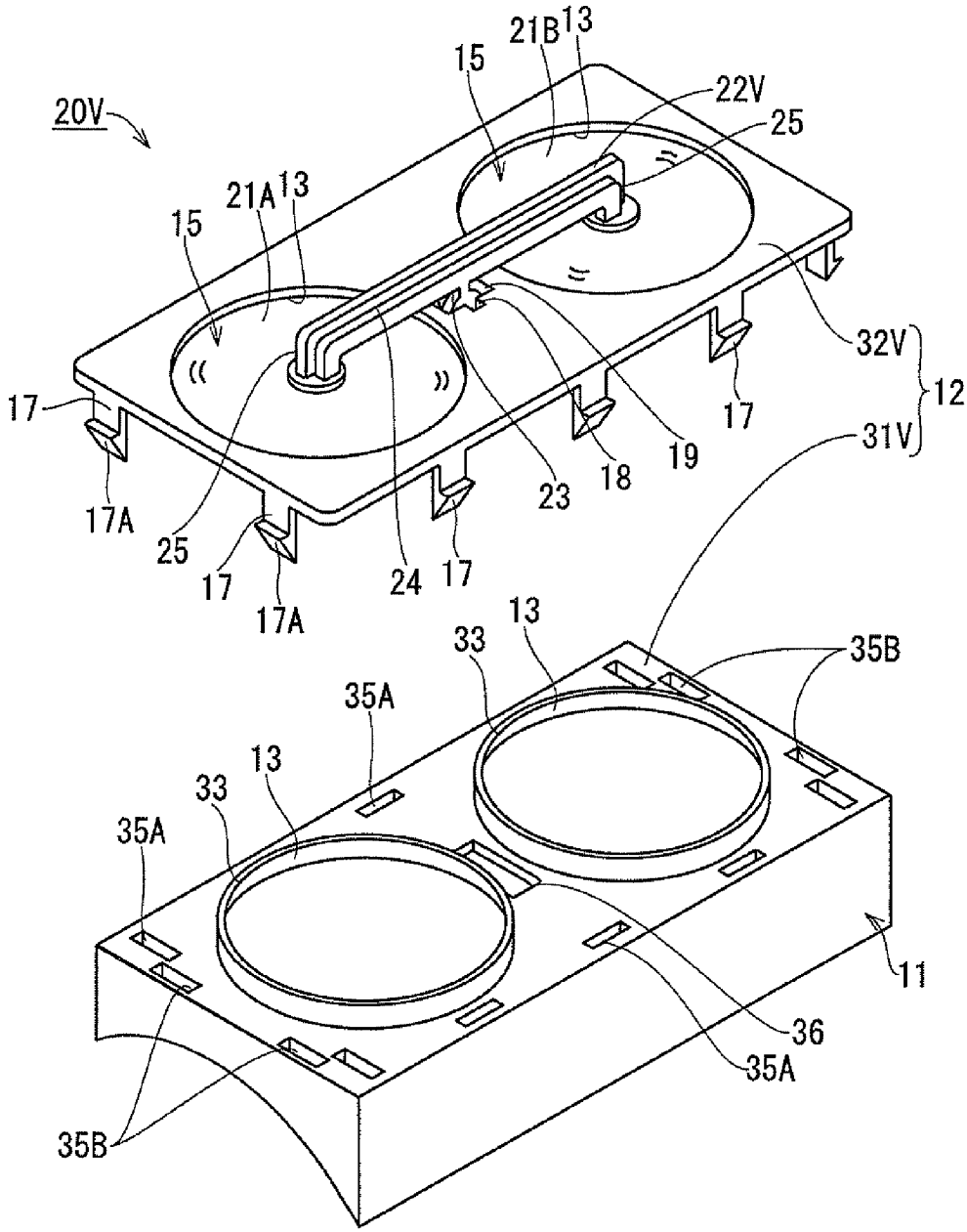
FIG. 8 is an exploded perspective view of the duct.
Figure 10:
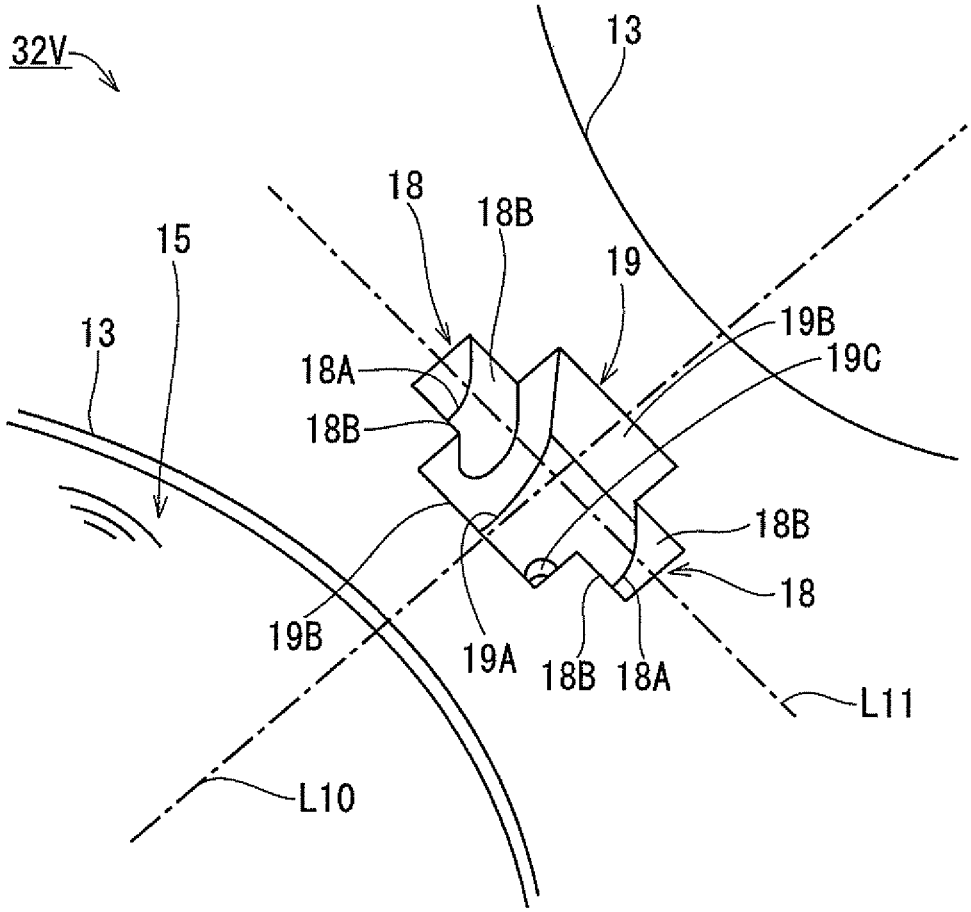
FIG. 10 is a perspective view of an interference avoiding recess and a shaft support groove.

The second base plate member 32V has an upper surface formed with the interference avoiding recess 19 between the through holes 13 as shown in FIG. 8. A center connecting line L10 (see FIG. 10) connects between centers of the paired through holes 13, and a pivot center line L11 (see FIGS. 10 and 11) is perpendicular to a central part of the center connecting line L10 and is coplanar with the membrane member 15 (more specifically, the upper surface of the membrane member 15). When these imaginary lines are drawn, the interference avoiding recess 19 is formed into an arc groove having a semicircular bottom 19A about the pivot center line L11. Furthermore, the interference avoiding recess 19 includes groove inner sides 198 which are opposed to each other with respect to the center connecting line L10 and inclined so that a distance therebetween is increased as the groove inner sides 198 are departed farther from the semicircular bottom 19A. The interference avoiding recess 19 has a circular foreign matter removing hole 19C formed through a central lowermost part of the semicircular bottom 19A as shown in FIG. 10.

Figure 11:
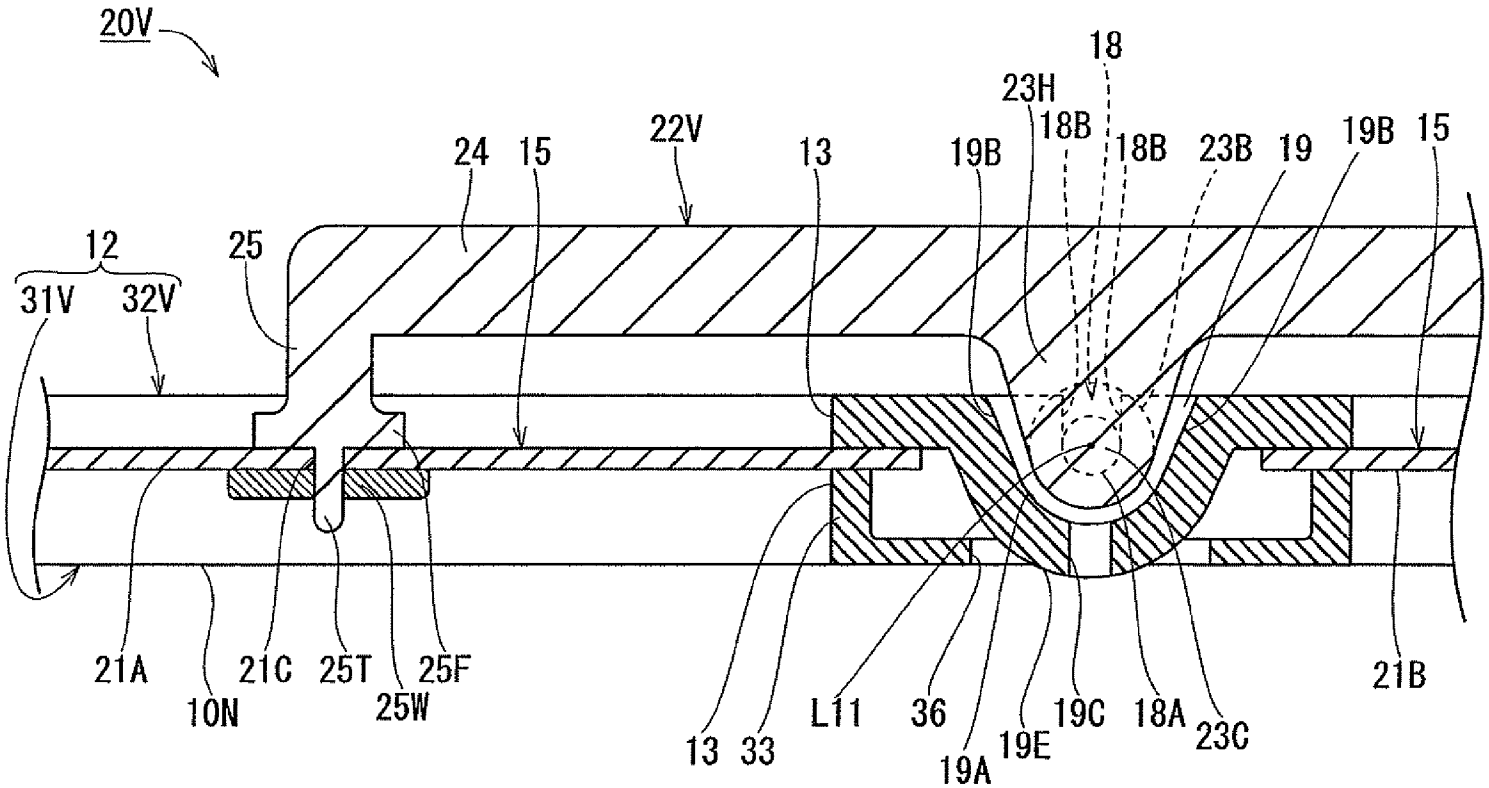
FIG. 11 is a partial sectional view of first and second base plates.

The upper surface of the second base plate member 32V is depressedly formed with two shaft support grooves 18 at both sides of the interference avoiding recess 19 respectively. Each shaft support groove 18 is formed into an arc groove having a smaller width and a smaller depth than the interference avoiding recess 19. Each shaft support groove 18 has a semicircular bottom 18A about the pivot center line L11 and communicates with both end surfaces of the interference avoiding recess 19. The shaft support groove 18 includes two groove inner sides 18B opposed to each other in an extending direction of the central connecting line L10. The groove inner sides 18B are opposed in parallel with each other as shown in FIG. 11.

Figure 12:
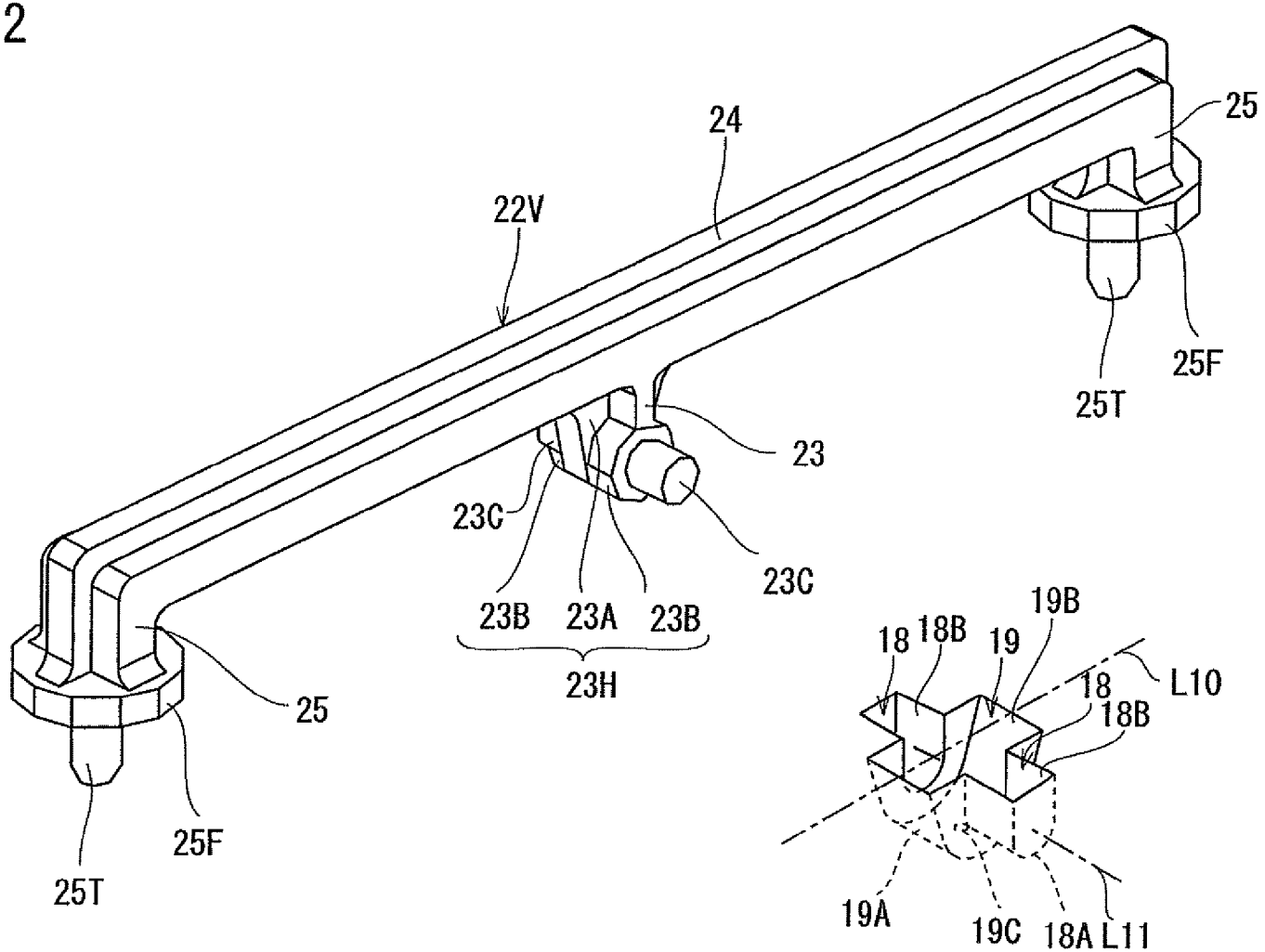
FIG. 12 is a perspective view of a seesaw member.

The seesaw member 22V has the end legs 25 of the second embodiment including vertically middle portions provided with circular flanges 25F respectively as shown in FIG. 12. Two rounded bar-shaped penetration shafts 25T protrude from central lower ends of the end legs 25 respectively. Each circular flange 25F is disposed so that the lower end surface thereof is coplanar with the above-described pivot center line L11 as shown in FIG. 11. The penetration shafts 25T are inserted through central holes 21C formed in central portions of the membranes 21A and 21B respectively (FIG. 11 shows only one central hole 210). Furthermore, the penetration shafts 25T are inserted through membrane fixing washers 25W from below the membranes 21A and 218, and the fixing washers 25W are then fixed to the penetration shafts 25T by an adhesive, respectively. As a result, the central portions of the membranes 21A and 215 are held between the washers 25W and the circular flanges 25F respectively.

The central leg 23 of the seesaw member 22V is provided with a pair of large-diameter shafts 238 protruding from both distal end sides of a projection 23A trailing down from a widthwise center of the connecting portion 24, as shown in FIG. 12. The pivot shafts 23C are configured to protrude from distal end surfaces of the large-diameter shafts 23B respectively. The large-diameter shafts 23B and the pivot shafts 23C are each formed into a rounded bar shape and coaxial with each other about the aforementioned pivot center line L11. The pivot shafts 23C are formed so as to be thinner than the large-diameter shafts 23B. A leg body 23H comprising the projection 23A and the large-diameter shafts 23B has a distal end which is received by the interference avoiding recess 19, whereas the paired pivot shafts 23C are received by the shaft support grooves 18 respectively. Furthermore, the pivot shafts 23C are in abutment with the respective circular bottoms 18A of the shaft support grooves 18 thereby to be slidably supported on the circular bottoms 18A as shown in FIG. 11, whereupon the leg body 23H floats above the inner surface of the interference avoiding recess 19. As a result, the seesaw member 22V is caused to pivot about the pivot center line L11.

The aforementioned foreign matter removing hole 19C has a diameter larger than a clearance between the leg body 23H and the inner surface of the interference avoiding recess 19.

Figure 13:
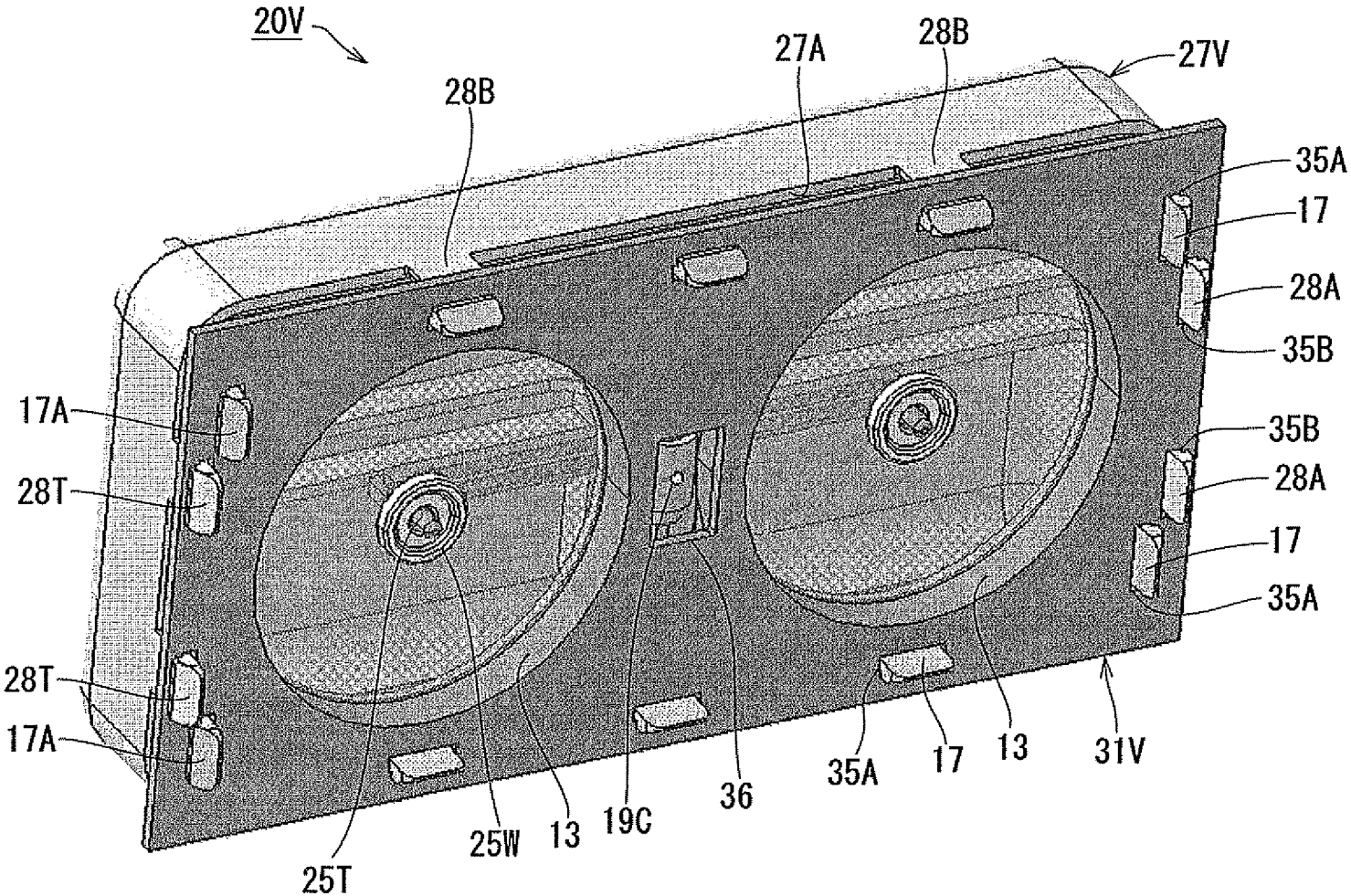
FIG. 13 is a perspective view of the underside of the noise attenuator.

A plurality of locking pieces 17 trail down from each of the outer edges of four sides of the second base plate member 32V as shown in FIG. 8. Each locking piece 17 has a distal end whose outer surface is provided with a triangular locking protrusion 17A. The locking pieces 17 are inserted into a plurality of first locking slits 35A formed through the first base plate member 31V, respectively. As shown in FIG. 13, the locking protrusions 17A are locked on the inner surface of the first base plate member 31V, whereby the second base plate member is integrally fixed to the first base plate member 31V.

Two annular protrusions 33 protrude from the upper surface of the first base plate member 31V toward the open edges of the circular through holes 13 of the second base plate member 32V, as shown in FIG. 8. The interiors of the annular protrusions 33 serve as the circular through holes 13 of the first base plate member 31V respectively. Furthermore, the membrane members 15 are held between the distal end surfaces of the annular protrusions 33 and the opening edges of the through holes 13 of the second base plate member 32V while the second base plate member 32V is fixed to the first base plate member 31V as shown in FIG. 11. Additionally, the first base plate member 31V has a central rectangular window 36 formed therethrough between the annular protrusions 33. The second base plate member 32V has a protrusion 19E formed on the rear surface of the interference avoiding recess 19. The protrusion 19E is inserted into the window 36.

Figure 6:
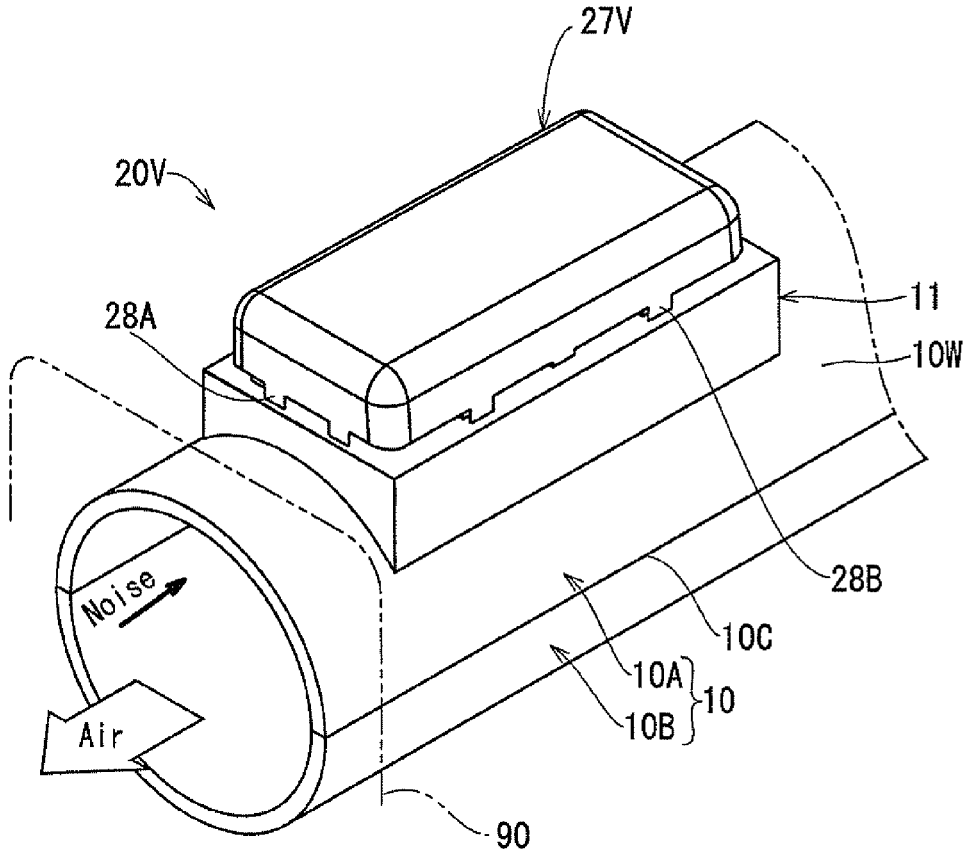
FIG. 6 is a perspective view of an air intake duct provided with the noise attenuator of a second embodiment.
Figure 14:
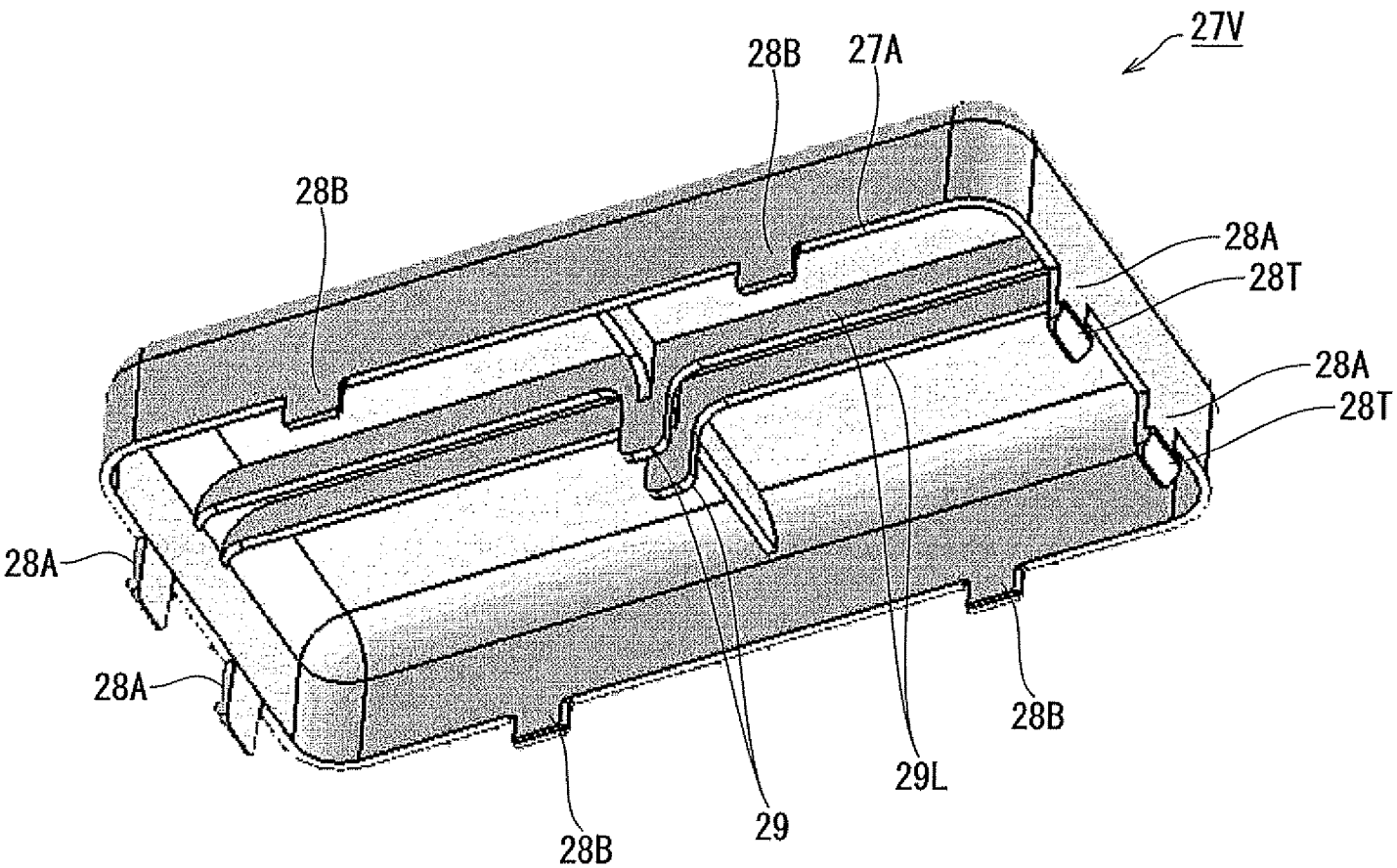
FIG. 14 is a perspective view of the underside of an outer surface cover.

The outer surface of the noise attenuator 20V is covered by an outer surface cover 27V as shown in FIG. 6. The cover 27V is formed into a vertically shallow rectangular parallelepiped structure and has an entire open bottom as shown in FIG. 14. The cover 27V is rectangular, slightly larger than the second base plate member, 32V and slightly smaller than the first base plate member 31V in the planar shape. The cover 27V has a rectangular opening 27A with two shorter sides and two longer sides on the bottom thereof. Each shorter side of the opening 27A has a plurality of locking pieces 28A trailing down from an opening edge thereof. Each longer side of the opening 27A has a plurality of butting pieces 28B trailing down from an opening edge thereof. Each butting piece 28B is in the shape of a protrusion having a lower end formed into a flat surface. Each locking piece 28A extends downward longer than the butting pieces 28B and has a locking protrusion 28T on an outer surface thereof in the same manner as the locking protrusion 17A of each locking piece 17. Distal end surfaces of the butting pieces 28B are butted against the upper surface of the first base plate member 31V, whereas the locking pieces 28A are inserted through second locking slits 35B formed through the first base plate member 31V so that the locking protrusions 28T are locked on an inner surface of the first base plate member 31V, whereby the cover 27V is fixed to the first base plate member 31V, as shown in FIG. 13.

The cover 27V has a pair of ceiling ribs 291, which are formed on an inner top surface thereof so as to extend in the same direction as the seesaw member 22V as shown in FIG. 14. Paired retaining strips 29 trail down from central portions of the ceiling ribs 29L respectively. The retaining strips 29 are butted against the upper surface (not shown) of the second base plate member 32V, while extending across the upper openings of the shaft support grooves 18 of the second base plate member 32V, whereby the pivot shafts 23C are retained in the shaft support grooves 18 respectively.

The configuration of the noise attenuator 20V of the second embodiment has been described above. The noise attenuator 20V includes the foreign matter removing hole 19C which is formed in the bottom of the interference avoiding recess 19 receiving the central leg 23 of the seesaw member 22, as shown in FIG. 11. Accordingly, even when dust or the like enters the clearance between the central leg 23 and the interference avoiding recess 19, the dust or the like, when subjected to the negative pressure in the duct 10, is removed from the foreign matter removing hole 19C into the duct 10, whereupon the dust or the like can be prevented from remaining in the clearance between the leg body 23H and the inner surface of the interference avoiding recess 19. Consequently, since the seesaw member 22V is maintained in a smoothly pivotable state, the reduction in the noise attenuating performance can be prevented and the durability of the noise attenuator 20V can be improved.

Third Embodiment

Figure 15:
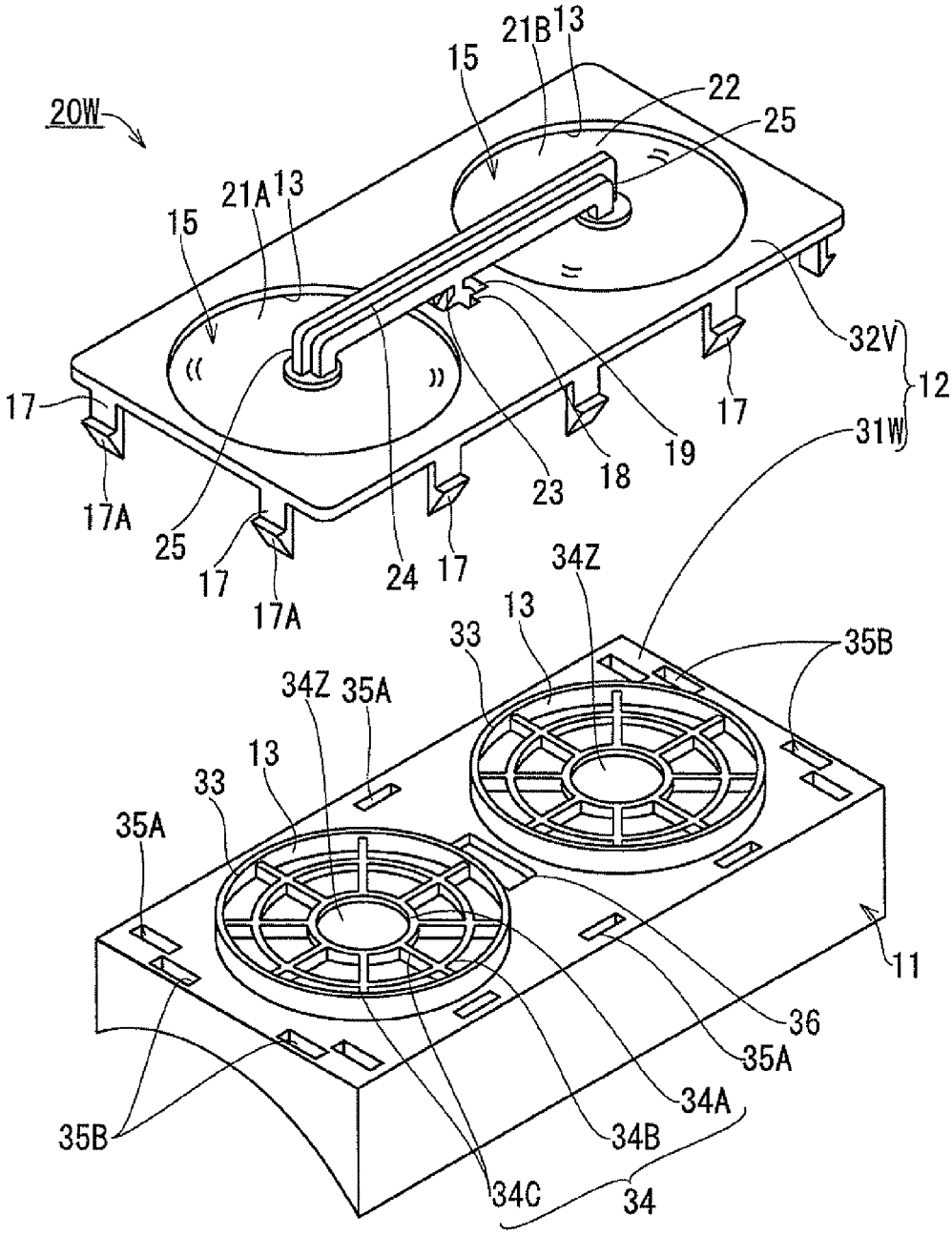
FIG. 15 is an exploded perspective view of the air intake duct provided with the noise attenuator of a third embodiment.
Figure 16:
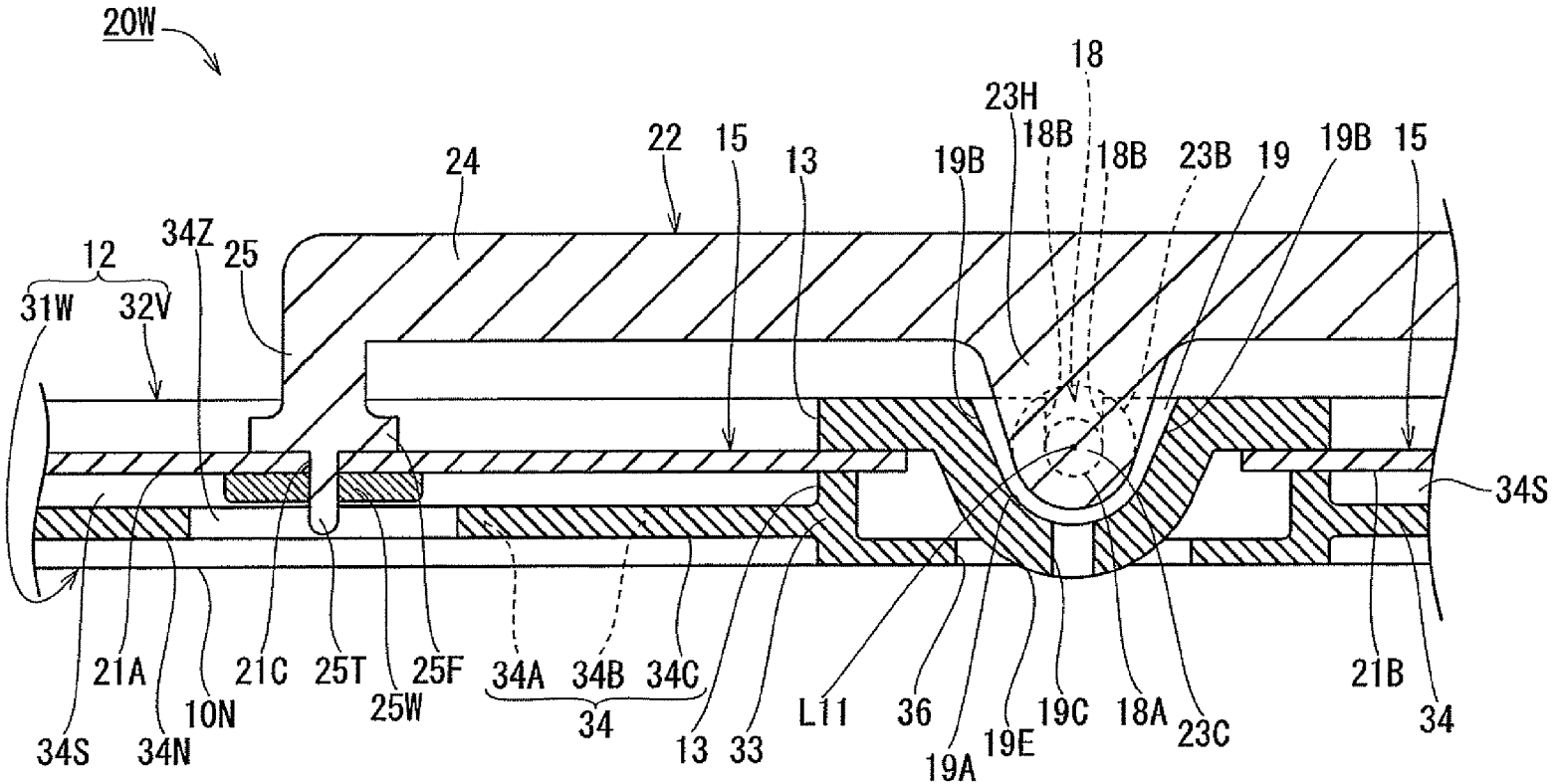
FIG. 16 is a partial sectional view of first and second base plates.
Figure 17:
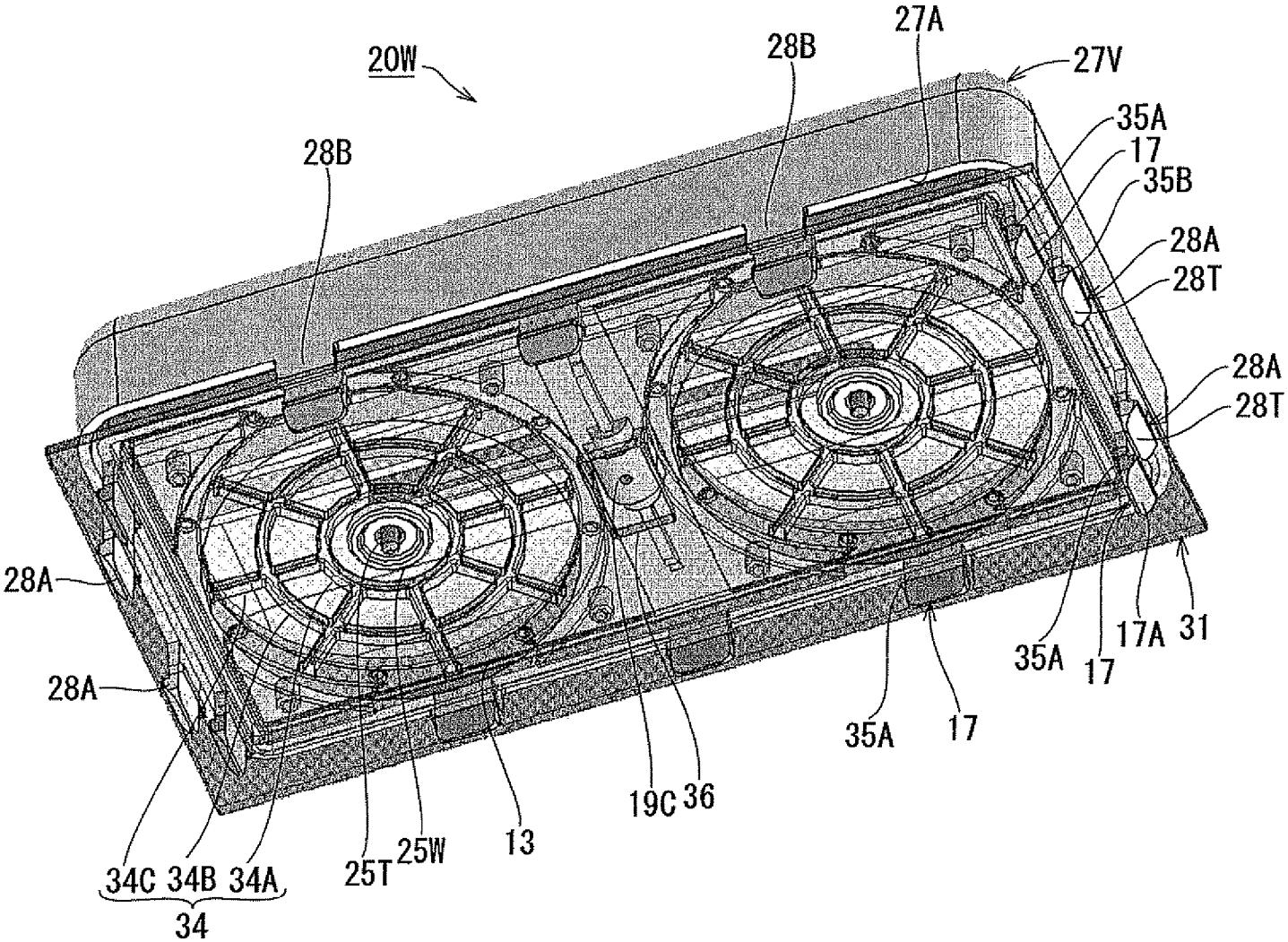
FIG. 17 is a perspective view of the underside of the noise attenuator.

The following describes the difference of the configuration of a noise attenuator 20W of a third embodiment from the noise attenuator 20V of the second embodiment with reference to FIGS. 15 to 17.

The noise attenuator 20W differs from the noise attenuator 20V in that inner limiting members 34 are provided inside the circular through holes 13 of the base plate member 31W respectively, as shown in FIG. 15. Each inner limiting member 34 includes a plurality of beams 34C, a first annular portion 34A and a second annular portion 34B. The beams 34C extend toward the center of the through hole 13 from positions obtained by dividing the inner circumferential surface of the through hole 13 into eight equal parts, for example. The first annular portion 34A is concentric with the through hole 13 and connects among distal ends of the beams 34C. The second annular portion 34B connects among middle portions of the beams 34C. A space surrounded by the first annular portion 34A serves as an escape hole 34Z. The escape hole 34Z has an inner diameter larger than an outer diameter of the membrane fixing washer 25W as shown in FIGS. 16 and 17, whereupon the interference is avoided between the membrane fixing washer 25W and the inner limiting member 34.

Furthermore, the inner limiting member 34 is located in the axial middle of the through hole 13 of the first base plate member 31W and opposed to inner surfaces of the membranes 21A and 21B via a gap 34S. The gap 34S is so sized that vibration of the membranes 21A and 21B due to sound is allowed. More specifically, the membranes 21A and 21B are adapted not to contact the inner limiting member 34 in the case of vibration of the membranes 21A and 21B due to sound. On the other hand, the gap 34S is also set so that the membranes 21A and 21B abut against the inner limiting members 34 when deformed so as to be swollen inward by the negative pressure in the duct 10.

Furthermore, the inner limiting member 34 includes an inwardly directed surface 34N directed to the inner surface 10N of the duct 10 and displaced outward relative to the inner surface 10N. More specifically, the inner limiting member 34 is designed so as not to protrude inward from the inner surface 10N of the duct 10, whereupon an increase in the suction resistance in the duct 10 by the inner limiting member 34 can be suppressed.

The noise attenuator 20W of the third embodiment is constructed as described above. Next, the operation and effects of the noise attenuator 20W will be described. In the noise attenuator 20W of the third embodiment as well, a cancellation wave having an opposite phase to the sound waves received by the membrane 21A is transmitted from the other membrane 21B, whereupon the noise can be attenuated in the same manner as the noise attenuators 20 and 20V of the first and second embodiments.

When foreign matter such as a plastic bag sticks to the front of a moving vehicle and covers an air intake of the duct 10, the negative pressure in the duct 10 is rapidly increased such that the membranes 21A and 21B are drawn inward. In the third embodiment, however, since the inner limiting members 34 are opposed to the inner surfaces of the membranes 21A and 21B respectively, the membranes 21A and 21B flexed by the negative pressure in the duct 10 abut against the inner limiting members 34, whereby the membranes 21A and 21B are prevented from an excessive deformation. Subsequently, when the plastic bag is removed from the vehicle such that the normal negative pressure state is recovered in the duct 10, the membranes 21A and 21B are spaced apart from the inner limiting members 34 to be returned to a vibratable state with respect to the noise. As a result, the noise attenuator 20W can be prevented from reduction in the noise attenuating performance, and the durability of the noise attenuator 20W can be improved. Furthermore, since the inner limiting members 34 prevent collision of foreign matter (a tool or the like during maintenance, for example) against the membranes 21A and 21B, the noise attenuator 20W can be prevented from reduction in the noise attenuating performance, and the durability of the noise attenuator 20W can be improved.

Fourth Embodiment

Figure 18:
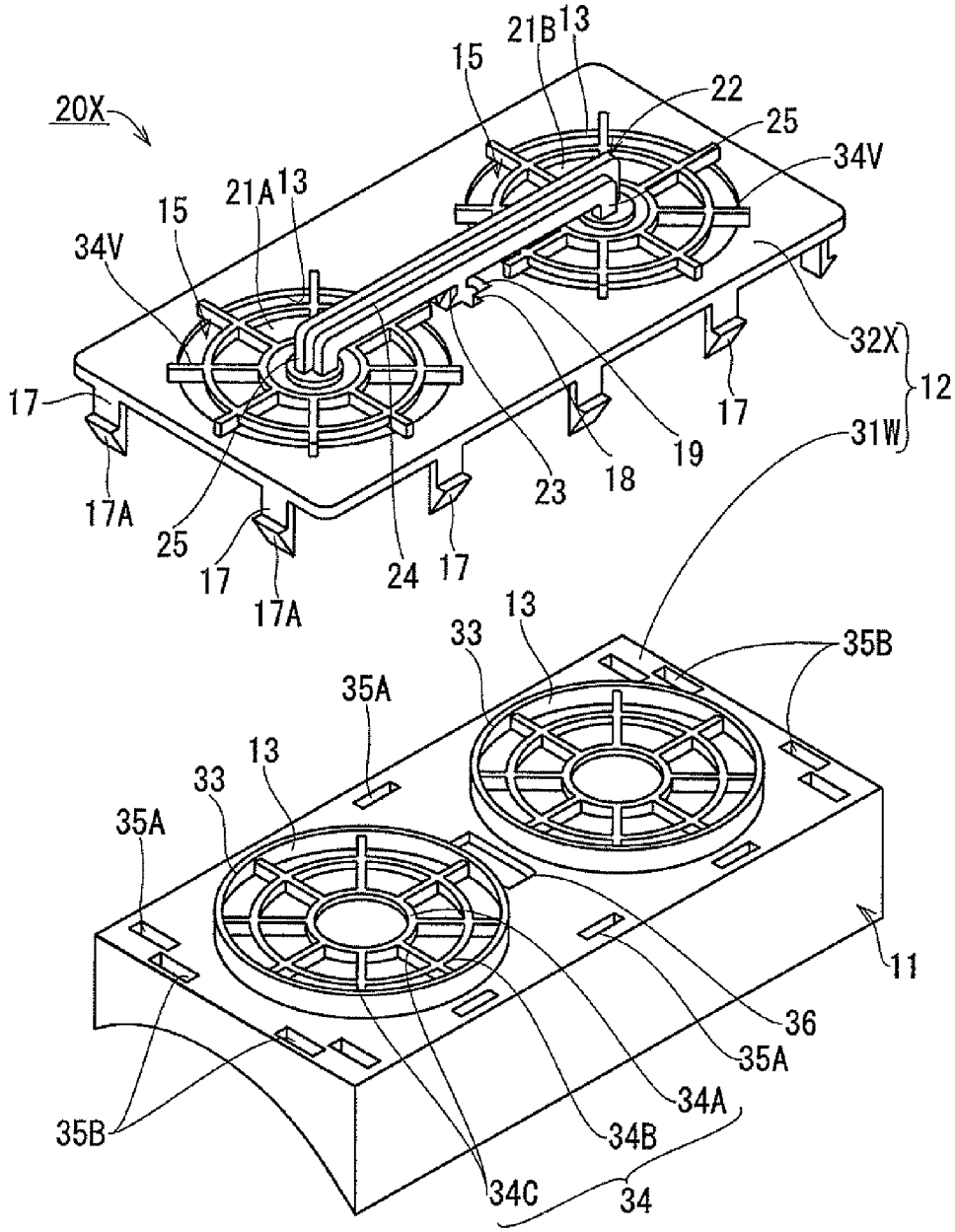
FIG. 18 is an exploded perspective view of an air intake duct provided with the noise attenuator of a fourth embodiment.

The following describes the difference of the configuration of a noise attenuator 20X of a fourth embodiment from the noise attenuator 20W of the third embodiment with reference to FIG. 18. The noise attenuator 20X includes a pair of outer limiting members 34V having the same configuration as the inner limiting member 34 of the first base plate member 31W. The outer limiting members 34V are provided so as to cover the respective circular through holes 13 of the second base plate member 32X from above. The outer limiting members 34V are fixed to opening edges of the upper surfaces of the through holes 13 respectively. Furthermore, the outer limiting members 34V are designed not to contact the membranes 21A and 21B vibrated due to sound but to contact the membranes 21A and 21B swollen outward by pressurization in the duct 10 respectively. The other configuration of the noise attenuator 20X is the same as that of the third embodiment.

According to the above-described noise attenuator 20X, an excessive deformation of the membranes 21A and 218 can be prevented by the outer limiting members 34V even when the interior of the duct 10 is in the pressurized state such that the membranes 21A and 21B are outwardly swollen.

The following describes the results of comparative experiments of noise attenuation effect conducted with embodiment products 1, 2 and 3 and comparative products 1 and 2 each of which lacks part of features of the invention. Embodiment product 1 includes a duct 10 having an entire length L1 of 400 mm and an inner diameter D3 of ϕ56 mm and the noise attenuator 20 of the first embodiment located at a position near a lengthwise terminal end of the duct 10. The membranes 21A and 21B have diameters (namely, diameters of through holes 13) D1 and D2 set to ϕ50 mm, an inter-center distance L3 which is a distance between the centers of the membranes 21A and 21B and which is set to 60 mm and a distance L2 of 100 mm from the terminal end of the duct 10 to a middle location between the centers of the membranes 21A and 2113. Furthermore, each of the membranes 21A and 21B is made of ethylene-propylene rubber and has the same membrane thickness of 0.3 mm.

Embodiment product 2 includes the noise attenuator 20 in which the membranes 21A and 21B have the respective diameters D1 and D2 of ϕ35 mm and an inter-center distance L3 between the membranes 21A and 21B of 50 mm. Embodiment product 2 is the same as embodiment product 1 in the other respects. Embodiment product 3 includes the membranes 21A and 21B arranged in the direction perpendicular to an axial direction of the duct 10. Embodiment product 3 is the same as the experiment product 1 in the other respects.

Comparative product 1 has a mere cylindrical structure obtained by eliminating the noise attenuator 20 from embodiment product 1. More specifically, comparative product 1 is a cylindrical duct having an inner diameter of ϕ56 mm and the whole length of 400 mm. Comparative product 2 has a structure obtained by eliminating the seesaw member 22. The other structure of comparative product 2 is the same as embodiment product 1.

Experimental Method

Figure 20:
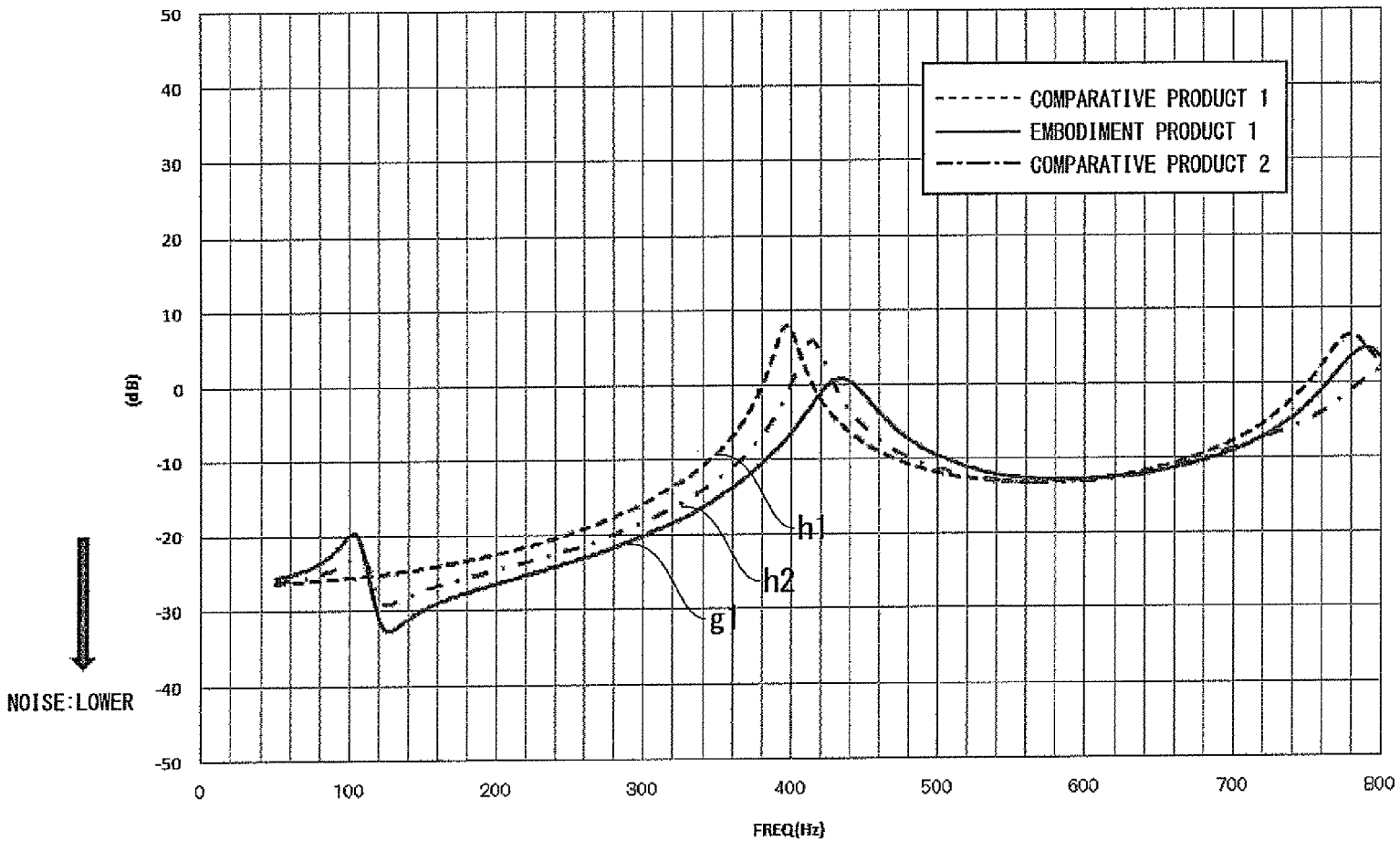
FIGS. 20 to 23 are graphs showing frequency and amount of reduced noise indicative of the results of a comparative experiment.
Figure 21:
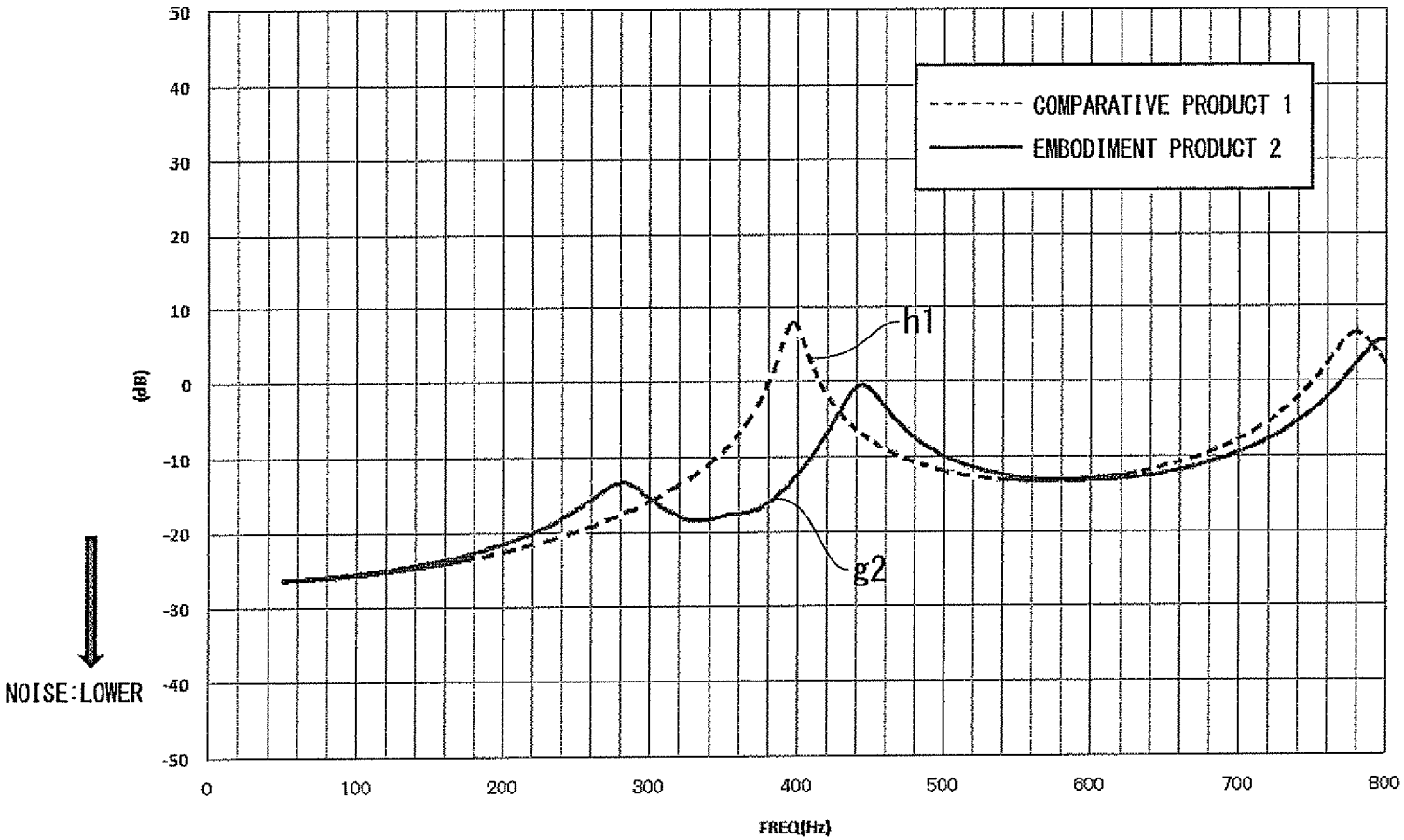
Figure 22:
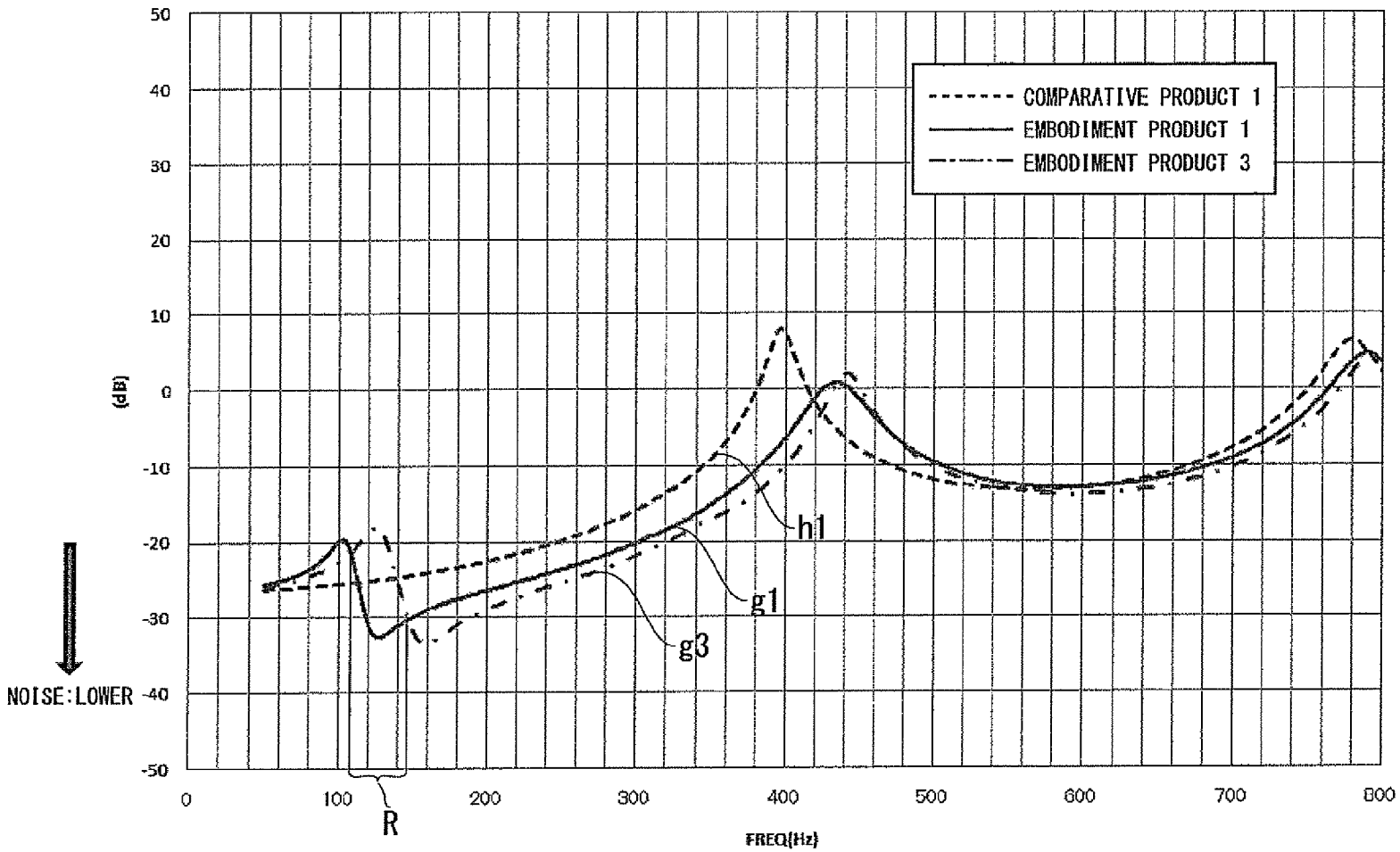

An experimental method is as follows. A loud speaker 92 was disposed so as to be opposed to a starting end opening of the duct 10 of embodiment product 1. A starting end microphone 91A and a terminal end microphone 91B were disposed at the starting end and the terminal end of the duct 10 respectively. While the frequency of sound to be output from the loud speaker 92 was changed in a range from 50 to 800 Hz, the sound was collected by the microphones 91A and 91B. A sound volume difference was obtained by subtracting a sound volume collected by the microphone 91A from a sound volume collected by the microphone 91B at every frequency, whereby graph g1 as shown in FIGS. 20 and 22 was plotted. Furthermore, graph g2 as shown in FIG. 21 was plotted with the use of embodiment product 2 in the same manner as described above, instead of embodiment product 1. Graph g3 as shown in FIG. 22 was also plotted with the use of embodiment product 3. Graph h1 as shown in FIGS. 20 to 22 was plotted with the use of comparative product 1. Graph h2 as shown in FIG. 20 was plotted with the use of comparative product 2.

Experimental Results

The experiment has confirmed that embodiment product 1 (graph g1) comprising the duct 10 with the noise attenuator 20 achieved a noise attenuating effect in a frequency band of 130 to 400 Hz as compared with comparative product h1 (graph h1) comprising the duct 10 without the noise attenuator 20 as shown in FIG. 20. Thus, since the noise attenuating effect has been confirmed in a vast frequency band of 130 to 400 Hz, the present invention is effective in the case where noise attenuation is required in a wider frequency band than a noise attenuator which is generally used in air intake ducts and is provided with a Helmholtz resonance chamber. Furthermore, a capacity ranging from 2000 to 3000 cc is necessary in the Helmholtz resonance chamber in order that a noise attenuating effect may be achieved by resonance with the noise with frequency of about 130 Hz. However, embodiment product 1 provided with the noise attenuator 20 of the present invention fits into the volume of 200×100×30 mm and the space of the capacity of 600 cc since embodiment product 1 has such a size that the membranes 21A and 21B each with ϕ50 mm are horizontally arranged and the seesaw member 22 is provided. Consequently, space saving can be achieved.

Furthermore, comparative product 2 (graph h2) comprising the membranes 21A and 21B which are not connected by the seesaw member 22 can achieve a certain noise attenuating effect, as shown in FIG. 20. However, the experiment has confirmed that embodiment product 1 (graph g1) comprising the membranes 21A and 21B which are connected by the seesaw member 22 achieved a larger noise attenuating effect than comparative product 2 (graph h2).

The experiment has further confirmed on graph g1 (see FIG. 20) that a structure of the membranes 21A and 21B and the seesaw member 22 of embodiment product 1 provided with the noise attenuator 20 in the duct 10 had a natural frequency of about 120 Hz and that the noise attenuating effect rapidly changed (violently fluctuated) at frequencies before and after the natural frequency which could also appear in the case of an ordinary noise attenuator. However, graph g2 (see FIG. 21) of embodiment product 2 differing in diameters of the membranes 21A and 21B from embodiment product 1 shows that the frequency at which the noise attenuating effect rapidly changed (violently fluctuated) was shifted to frequencies before and after 300 Hz and that the frequency band in which noise could be attenuated and the noise attenuating effect also changed. Consequently, a target noise is considered to be able to be efficiently attenuated by changing diameters of the membranes 21A and 21B according to a frequency of noise.

Furthermore, as shown in FIG. 22, the experiment has confirmed that a higher noise attenuating effect was achieved in a low frequency range from 110 to 140 Hz ("R" in FIG. 22) in the case where the membranes 21A and 21B were arranged in a transmitting direction of sound than in the case where the membranes 21A and 21B were arranged in the direction perpendicular to the transmitting direction of sound.

Example 2

Figure 19:
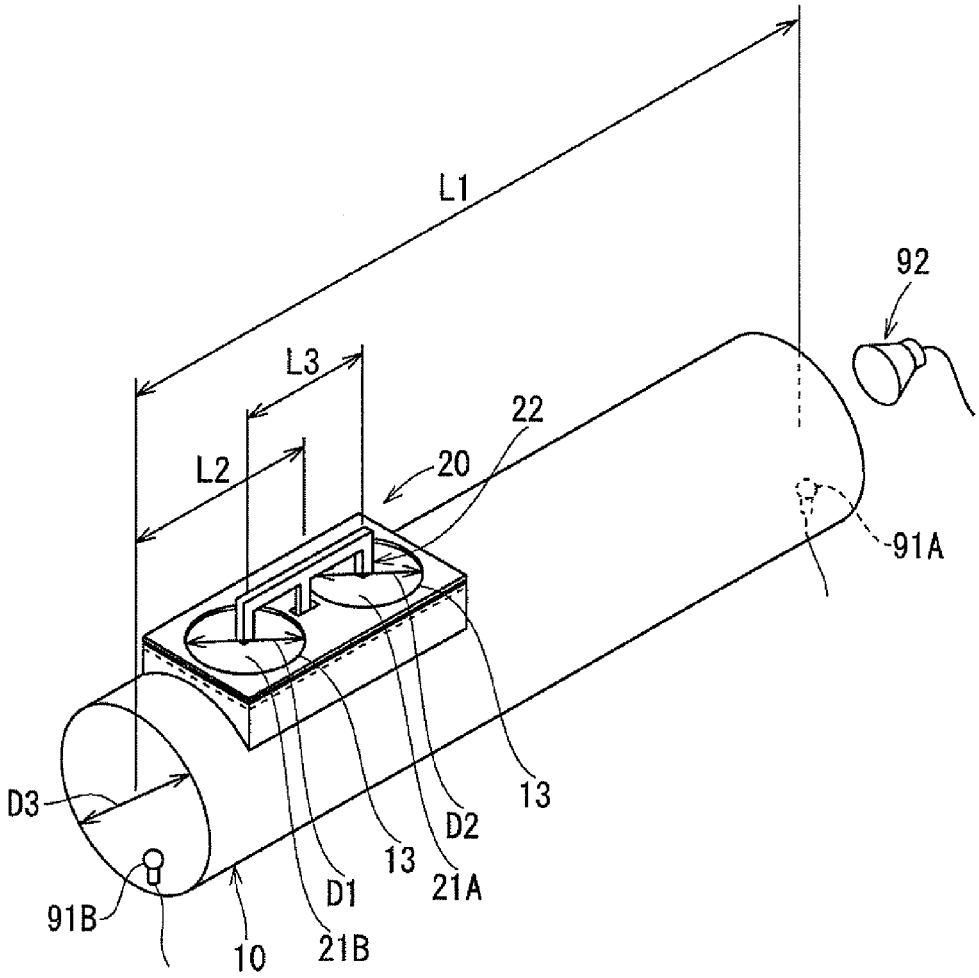
FIG. 19 is a perspective view of an embodiment product of the present invention.

Embodiment product 4 having the inner limiting member of the present invention and embodiment product 5 having the same structure without the inner limiting member were made. An experiment was conducted to examine influences of the provision of the inner limiting member upon the noise attenuating effect. In embodiment product 4, the membrane noise attenuating mechanism 20 having the same structure as the noise attenuator of the third embodiment was provided at a position near the lengthwise terminal end of the duct 10 having an entire length L1 of 400 mm and an inner diameter D3 of ϕ56 mm as shown in FIG. 19. The membrane noise attenuating mechanism 20 included the membranes 21A and 21B having diameters (that is, diameters of through holes 13) D1 and D2 of ϕ55 mm. The inter-center distance L3 of the membranes 21A and 21B was 65 mm and the distance L2 from the terminal end of the duct 10 to the middle position between centers of the membranes 21A and 21B was 100 mm. Each of the membranes 21A and 213 comprised a thermoplastic polyolefin (TPO) having a membrane thickness of 0.3 mm. A metal mesh with an aperture ratio of 70% was used as each inner limiting member 34. Each of the gaps 34S between the membranes 21A and 21B and the inner limiting members 34 was set to 1.5 mm. On the other hand, embodiment product 5 had a structure corresponding to embodiment product 4 without the inner limiting members 34 in the membrane noise attenuating mechanism 20 as described above.

Experimental Method

The experimental method is as follows.

Figure 23:
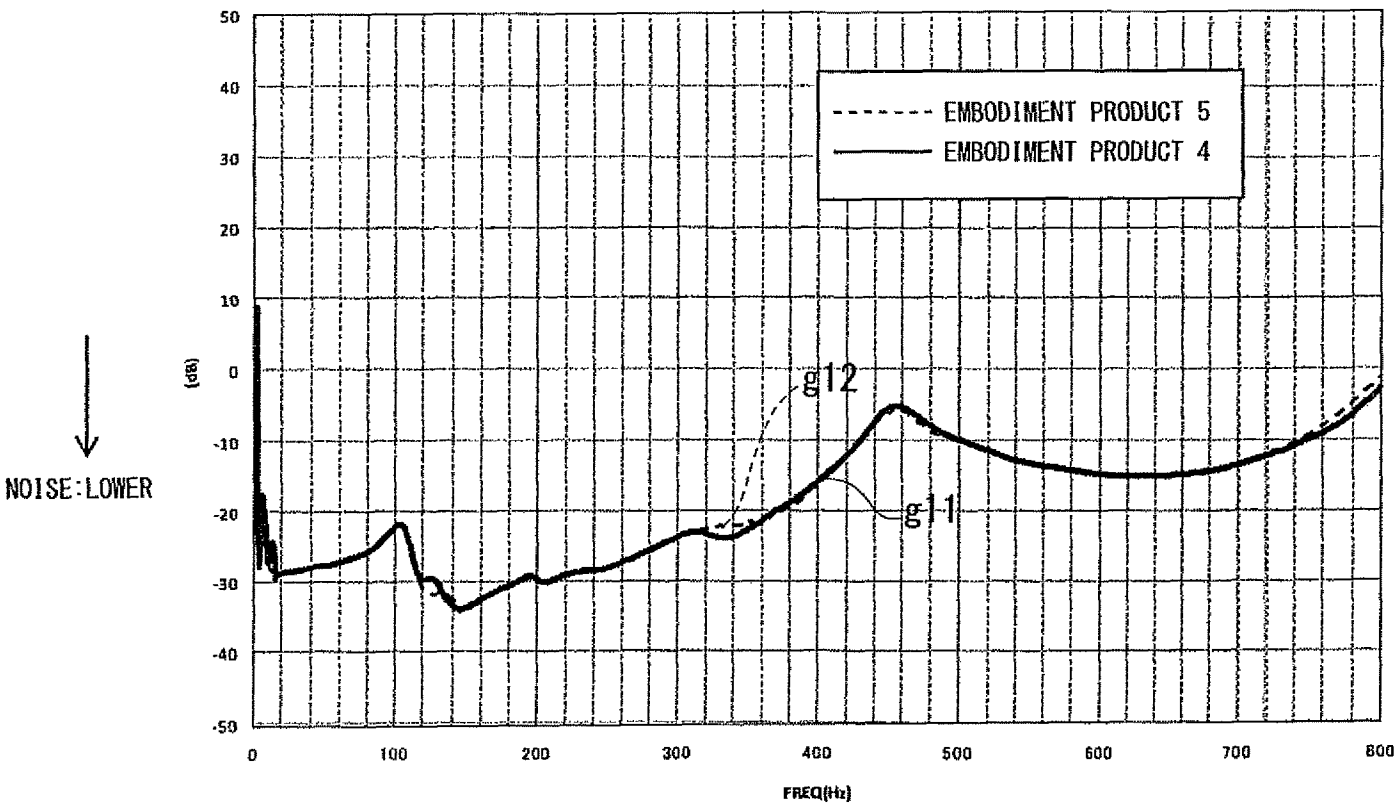

A loud speaker 92 was disposed opposite to the start end opening of the duct 10 of embodiment product 4. A start end microphone 91A and a terminal end microphone 91B were disposed at the start end and the terminal end of the duct 10 respectively. Sound to be output from the speaker 92 was collected by the start end microphone 91A and the terminal end microphone 91B while the frequency of sound to be output from the speaker 92 was changed in a range from 50 to 800 Hz. A sound volume difference was obtained by subtracting a sound volume collected by the microphone 91A from a sound volume collected by the microphone 91B at every frequency, whereby graph g11 as shown in FIG. 23 was plotted. Furthermore, graph g12 as shown in FIG. 23 was plotted with the use of embodiment product 5 in the same manner as described above, instead of embodiment product 4.

A suction unit was connected to an end opening at the side of the duct 10 of embodiment product 4 away from the membrane noise attenuating mechanism 20. While suction at a suction rate of 6.5 $m^3$/min was performed, the other end side opening was closed by a hand for 10 seconds, and the membranes 21A and 21B were pressed against the inner limiting members 34. Thereafter, whether or not the membranes 21A and 21B were returned to the respective former states was visually confirmed.

Experimental Results

The experiment has confirmed that the noise attenuating effect was almost not affected by the provision of the inner limiting members 34 since graphs g11 and g12 of FIG. 23 corresponded with each other. Furthermore, the membranes 21A and 21B were returned to the respective former states without plastic deformation even when pressed against the inner limiting members 34. Consequently, the experiment has confirmed that the inner limiting members 34 have an effect of preventing excessive deformation of the membranes 21A and 21B.

Other Embodiments

The present invention should not be restricted to the aforedescribed embodiments, and the following embodiments are also included in the technical scope of the present invention, for example. Further, the present invention can be modified in various ways other than the following embodiments without departing from the gist.

The seesaw member 22 connecting between the membranes 2A and 21B may be disposed inside the duct 10 although disposed outside the duct 10 in each of the first and second embodiments. However, since the seesaw member 22 is pivotable by wind pressure in the duct, it is desirable that the seesaw member should be disposed outside the duct.

Although only the noise attenuator 20, 20V and 20Z are disposed in the duct 10 in the first to third embodiments, a known noise attenuator and the noise attenuator according to the present invention may be provided in combination in the duct.

Although the noise attenuators 20, 20V and 20W are provided on the ducts 10 and 10Z in the first to third embodiments respectively, each noise attenuator may be provided on another duct or a part other than the duct, instead. For example, a pair of circular through holes may be formed in an inner wall of the engine compartment of the vehicle and the membranes may be stretched, thereby constituting the noise attenuator according to the present invention.

Although the seesaw member 22 is mounted on the duct wall 10W in the first and second embodiments, the seesaw member may be mounted on a part other than the duct so far as the seesaw member is pivotable relative to the duct.

The cover 27 or 27V of the noise attenuator 20 or 20V in the first or second embodiment may be mounted on the base wall 12 by an adhesive or by welding although mounted on the base wall 12 by small screws or by locking pieces.

Although the foreign matter removing hole 19C is provided in the bottom of the interference avoiding recess 31A in the second embodiment, the foreign matter removing hole may be provided in an inner side surface of the interference avoiding recess 31A, instead.

The noise attenuator 20 of the first embodiment may include the interference avoiding recess 31A provided with the foreign matter removing hole 19C in the same manner as the noise attenuator 20X of the second embodiment.

Additionally, the inner limiting members 34 and the outer limiting members 34V in the noise attenuators 20W and 20X of the third and fourth embodiments are formed into a grid-like pattern, but the inner and outer limiting members 34 and 34V may be reticular in shape. Furthermore, each of the inner and outer limiting members 34 and 34V may be a beam extending across the through hole 13 and supported at both ends thereof or a cantilever beam protruding inward from the edge of the through hole 13. Additionally, when each of the inner and outer limiting members is beam-shaped, a single beam may be provided or a plurality of beams may be formed into a bar shape.

What is claimed is:

1. A noise attenuator which reduces noise transmitting in a duct, comprising:

a pair of circular through holes formed through a duct wall;

a pair of wave transmitting/receiving membranes which are stretched so as to close the respective circular through holes, receive a sound wave, and vibrate;

a seesaw member which connects between central portions of the paired transmitting/receiving membranes and is pivotally supported with respect to the duct so as to be capable of transmitting vibration between the paired wave transmitting/receiving membranes;

a central leg provided on the seesaw member and having a distal end pivotally supported on the duct wall; and an interference avoiding recess depressedly formed in the duct wall so as to avoid an interference with the distal end of the central leg, wherein the paired membranes and a pivot center of the seesaw member are coplanar with each other.

2. The noise attenuator according to claim 1, wherein the paired wave transmission/receiving membranes are arranged in a transmitting direction of sound waves in the duct.

3. The noise attenuator according to claim 2, wherein the seesaw member is disposed outside the duct wall, further comprising:

a foreign matter removing hole formed through an inner surface of the interference avoiding recess so as to discharge foreign matter having entered the interference avoiding recess into the duct.

4. The noise attenuator according to claim 2, further comprising:

an inner limiting member which is opposed to the inner surfaces of the wave transmitting/receiving membranes with a gap being defined therebetween, the inner limiting member being formed into a grid shape, a reticular shape, a bar shape or a beam shape.

5. The noise attenuator according to claim 1, wherein the seesaw member is disposed outside the duct wall, further comprising:

a foreign matter removing hole formed through an inner surface of the interference avoiding recess so as to discharge foreign matter having entered the interference avoiding recess into the duct.

6. The noise attenuator according to claim 5, further comprising:

a pair of pivot shafts which protrude from both side surfaces of the distal end of the central leg in directions opposed to each other and a pair of shaft support grooves which are formed on an outer surface of the duct wall and at both sides of the interference avoiding recess respectively, the shaft support grooves receiving and pivotally supporting the pivot shafts.

7. The noise attenuator according to claim 6, further comprising:

an outer surface cover which covers an outer surface of the duct wall as well as the seesaw member.

8. The noise attenuator according to claim 5, comprising:

an outer surface cover which covers an outer surface of the duct wall as well as the seesaw member.

9. The noise attenuator according to claim 5, further comprising:

an inner limiting member which is opposed to the inner surfaces of the wave transmitting/receiving membranes with a gap being defined therebetween, the inner limiting member being formed into a grid shape, a reticular shape, a bar shape or a beam shape.

10. The noise attenuator according to claim 1, further comprising:

a pivot limiting stopper which limits a range of pivotal movement of the seesaw member.

11. The noise attenuator according to claim 1, wherein the seesaw member is disposed outside the duct wall, further comprising:

an outer surface cover which covers an outer surface of the duct wall as well as the seesaw member.

12. The noise attenuator according to claim 1, further comprising:

an inner limiting member which is opposed to the inner surfaces of the wave transmitting/receiving membranes with a gap being defined therebetween, the inner limiting member being formed into a grid shape, a reticular shape, a bar shape or a beam shape.

13. The noise attenuator according to claim 12, wherein the inner limiting member is disposed at a position coplanar with an inner surface of the duct or displaced outward.

14. The noise attenuator according to claim 12, wherein the seesaw member is disposed outside the duct and fixed with distal ends thereof being inserted through the central portions of the wave transmitting/receiving membranes, and the inner limiting member has an escape hole to avoid interference with the distal ends of the seesaw member.

15. The noise attenuator according to claim 12, further comprising:

an outer limiting member which is disposed opposed to the outer surfaces of the wave transmitting/receiving membranes with a gap being defined therebetween, the outer limiting member being formed into a grid shape, a reticular shape, a bar shape or a beam shape.

16. The noise attenuator according to claim 1, further comprising:

an outer limiting member which is disposed opposed to the outer surfaces of the wave transmitting/receiving membranes with a gap being defined therebetween, the outer limiting member being formed into a grid shape, a reticular shape, a bar shape or a beam shape.

17. A vehicle air intake duct which is disposed along an air intake passage of an engine and provided with a noise attenuator according to claim 1.

* * * * *